US010162290B2

(12) United States Patent
Imaizumi et al.

(10) Patent No.: US 10,162,290 B2
(45) Date of Patent: Dec. 25, 2018

(54) IMAGE FORMING APPARATUS

(71) Applicant: CANON KABUSHIKI KAISHA, Tokyo (JP)

(72) Inventors: Chikara Imaizumi, Numazu (JP); Hiroyuki Matsumoto, Mishima (JP); Kazushi Suzuki, Suntou-gun (JP); Hiroshi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/529,063

(22) PCT Filed: Nov. 12, 2015

(86) PCT No.: PCT/JP2015/005645
§ 371 (c)(1),
(2) Date: May 23, 2017

(87) PCT Pub. No.: WO2016/088303
PCT Pub. Date: Jun. 9, 2016

(65) Prior Publication Data

US 2017/0308007 A1 Oct. 26, 2017

(30) Foreign Application Priority Data

Dec. 3, 2014 (JP) ..... 2014-244911

(51) Int. Cl.
*G03G 15/16* (2006.01)
*G03G 15/00* (2006.01)
*G03G 21/18* (2006.01)

(52) U.S. Cl.
CPC ..... *G03G 15/1615* (2013.01); *G03G 15/161* (2013.01); *G03G 15/757* (2013.01); *G03G 21/186* (2013.01)

(58) Field of Classification Search
CPC . G03G 15/161; G03G 15/1615; G03G 21/186
See application file for complete search history.

(56) References Cited

U.S. PATENT DOCUMENTS 6,317,572 B1 * 11/2001 Miyabe ..... G03G 15/757 399/111
6,349,188 B1 * 2/2002 Kawai ..... F16D 1/101 399/111

(Continued)

FOREIGN PATENT DOCUMENTS

EP 0735432 A1 10/1996
JP 10-10939 A 1/1998

(Continued)

*Primary Examiner* — Francis C Gray
(74) *Attorney, Agent, or Firm* — Canon USA, Inc. I.P. Division

(57) ABSTRACT

To efficiently transmit drive through couplings on one and another sides during forward rotation and reverse rotation. When first and second couplings are brought into engagement with each other and rotated in a forward direction, first and third drive transmission surfaces are brought into contact with each other to be rotated in the forward direction while producing components of force in directions in which the first and second couplings are drawn to each other in the rotational axis direction.
When the first and second couplings are brought into engagement with each other and rotated in a reverse direction, second and fourth drive transmission surfaces are brought into contact with each other to be rotated in the reverse direction without producing components of force in directions in which the first and second couplings are separated from each other in the rotational axis direction.

16 Claims, 17 Drawing Sheets

(56) References Cited

U.S. PATENT DOCUMENTS

| | | | | |
|---|---|---|---|---|
| 6,473,580 | B1 * | 10/2002 | Inomata | F16D 1/112 399/111 |
| 2006/0164500 | A1 * | 7/2006 | Marumoto | G03G 15/757 347/139 |
| 2010/0303503 | A1 * | 12/2010 | Woo | G03G 21/186 399/167 |
| 2015/0050080 | A1 * | 2/2015 | Morita | G03G 21/1647 403/345 |
| 2017/0153580 | A1 * | 6/2017 | Ueno | F16D 1/02 |

FOREIGN PATENT DOCUMENTS

| | | | | |
|---|---|---|---|---|
| JP | 11-109836 | A | | 4/1999 |
| JP | 2000-132061 | A | | 5/2000 |
| JP | 2005-62280 | A | | 3/2005 |
| JP | 2010-091969 | A | | 4/2010 |
| JP | 2011-132988 | A | | 7/2011 |
| JP | 2014214870 | A | * | 11/2014 |
| JP | 2015-067418 | A | | 4/2015 |
| WO | 2009/057818 | A1 | | 5/2009 |

* cited by examiner

[Fig. 1]
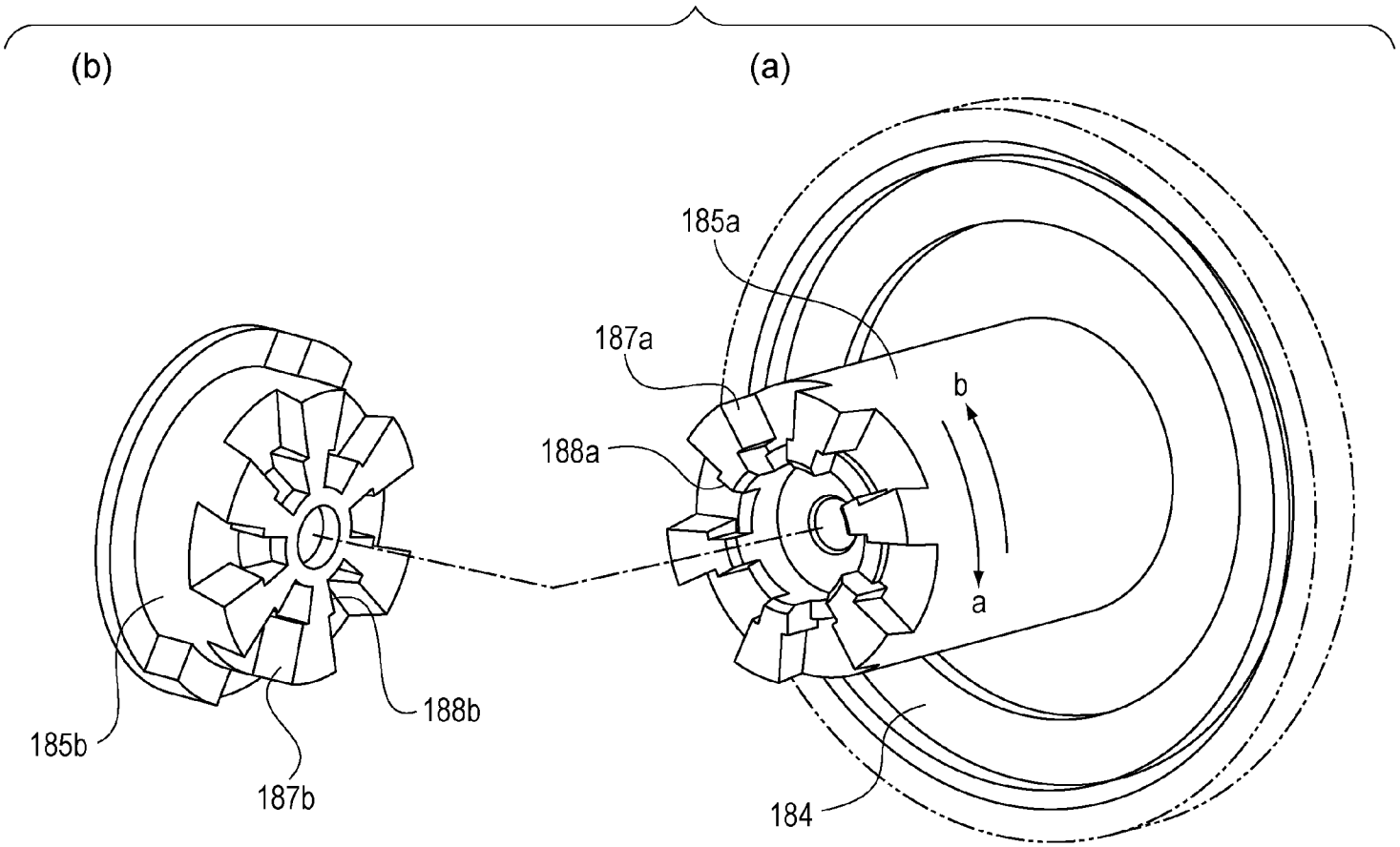

[Fig. 2]
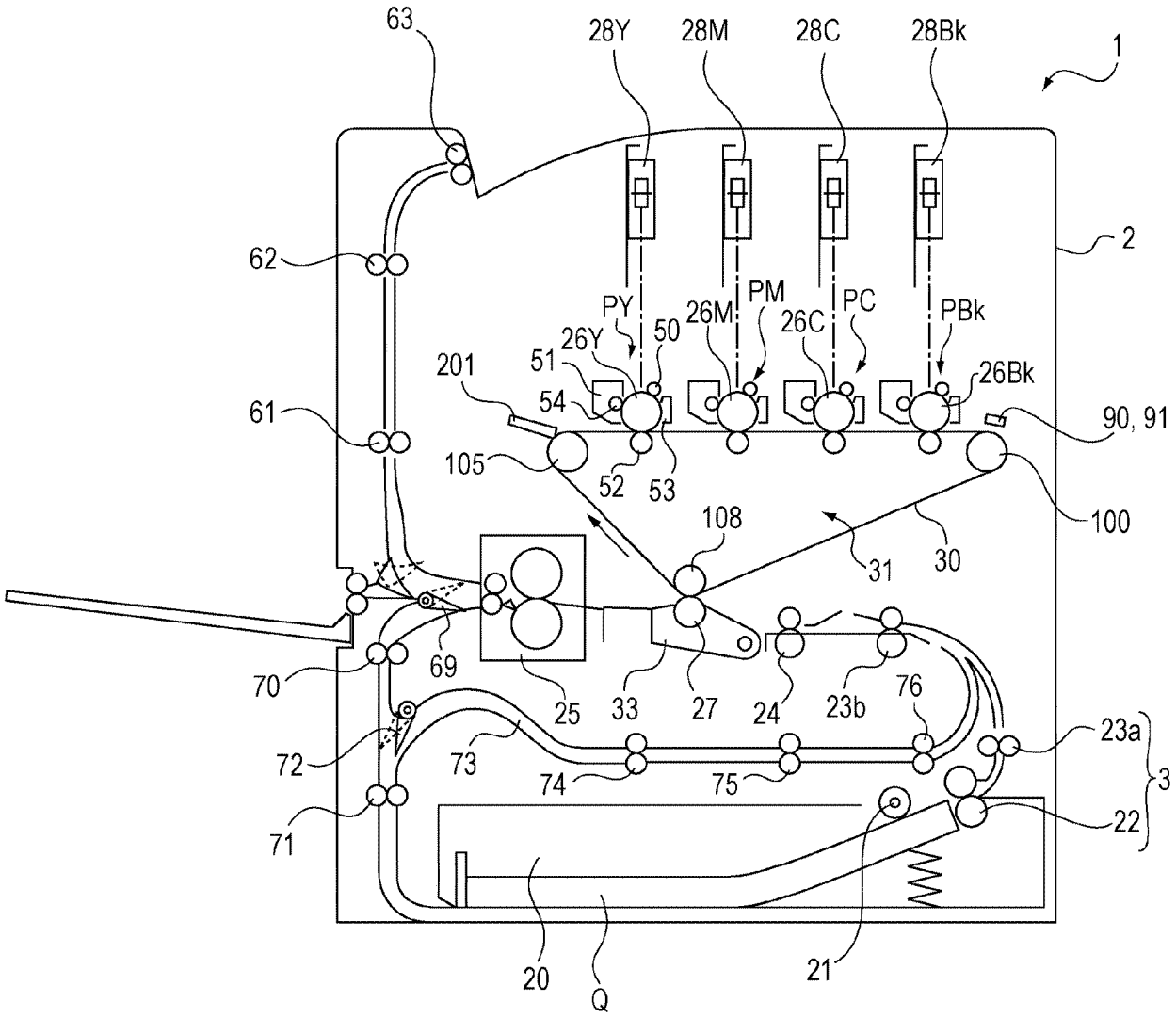

[Fig. 3]
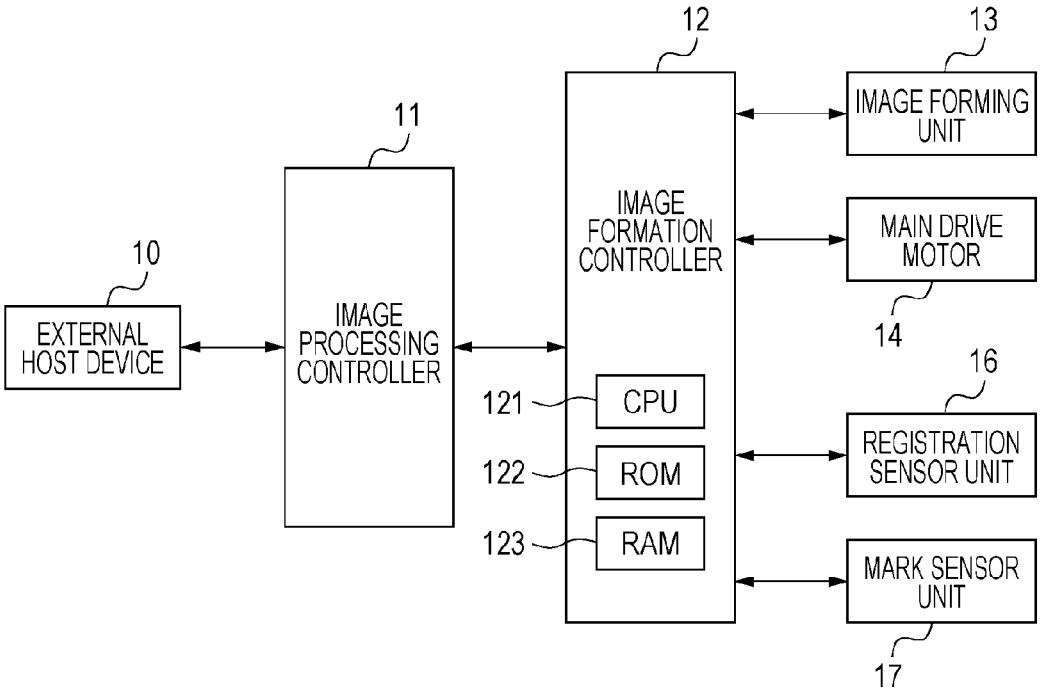

[Fig. 4]
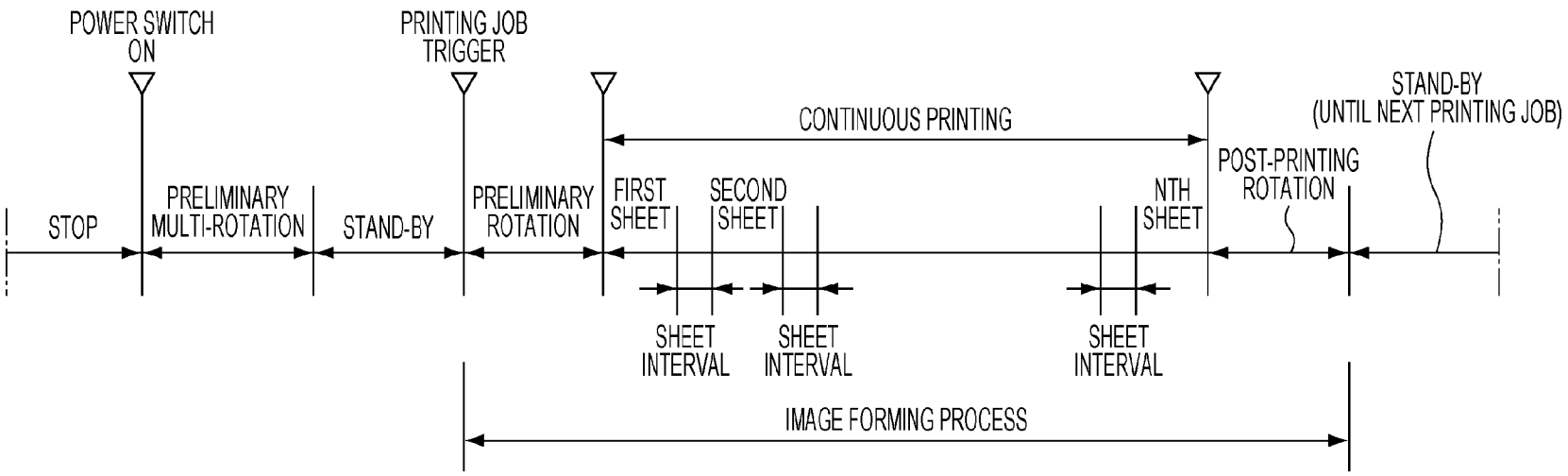

[Fig. 5]
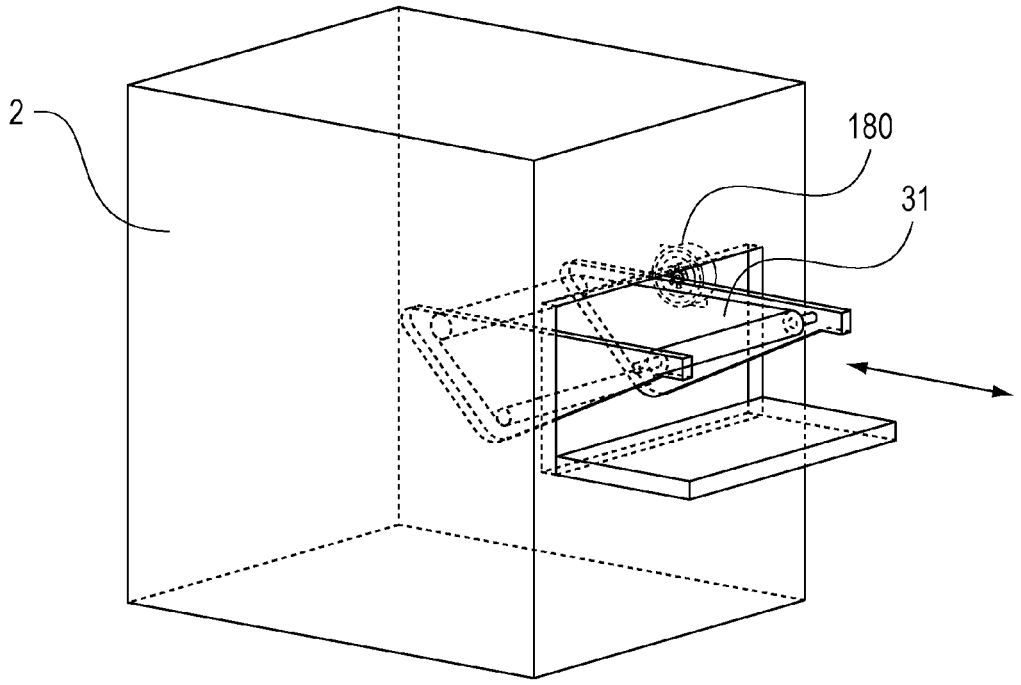
[Fig. 6]
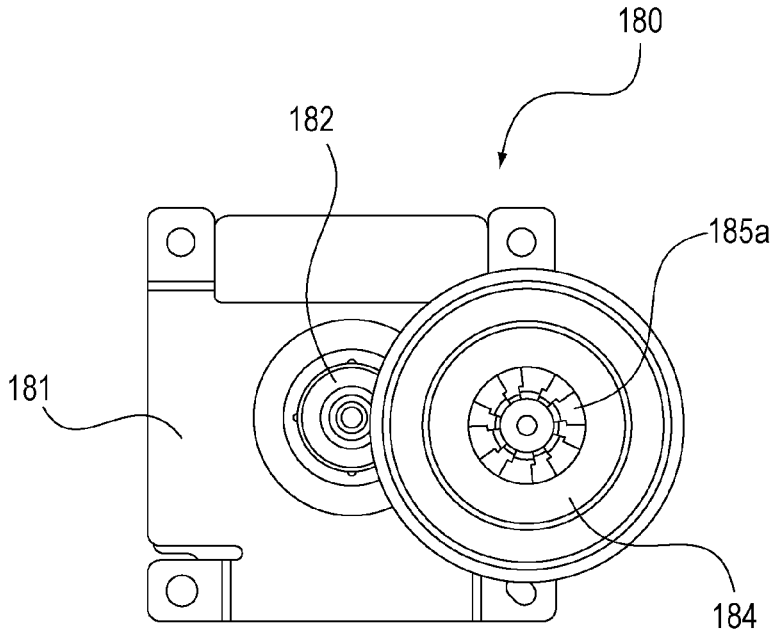

[Fig. 7]
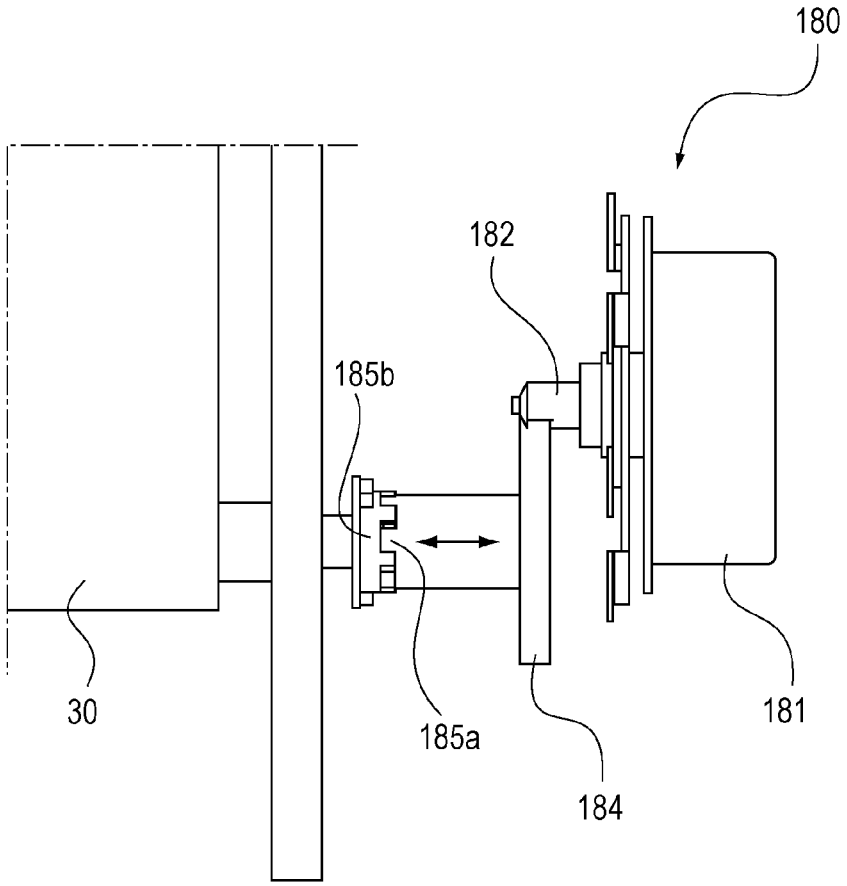

[Fig. 8]
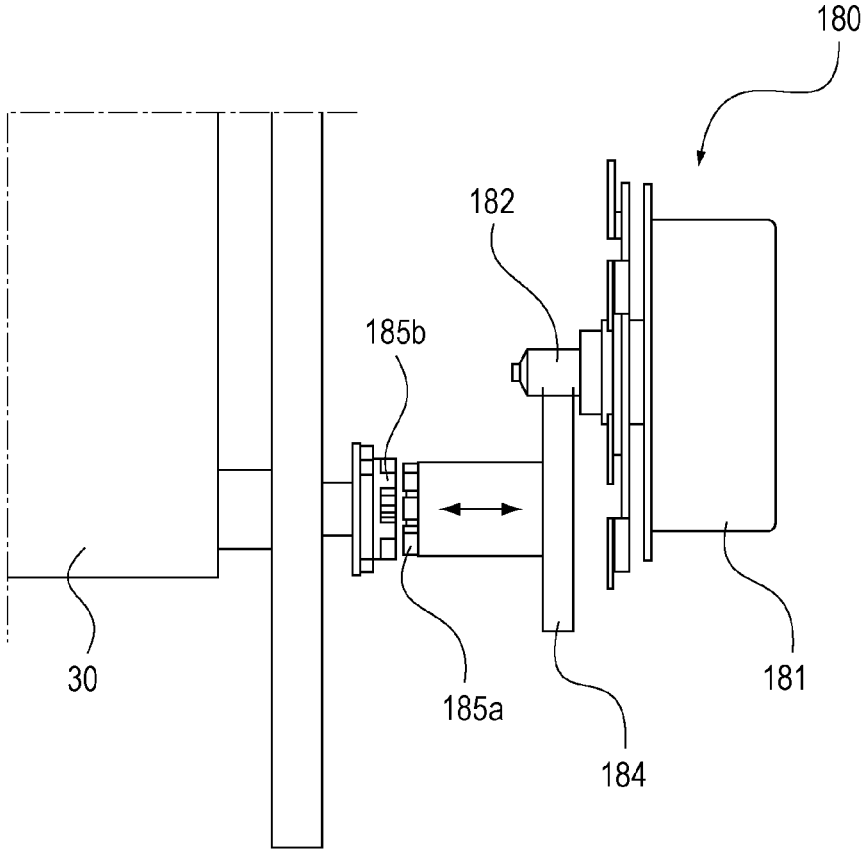

[Fig. 9]
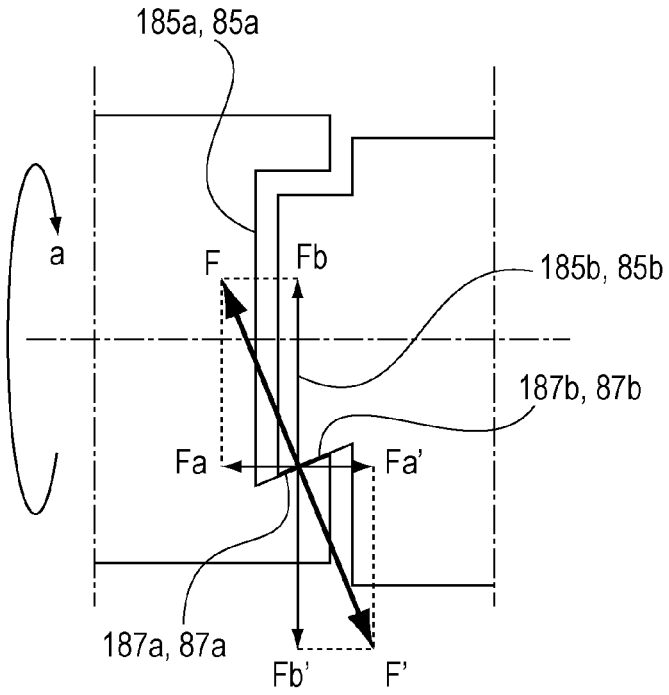
[Fig. 10]
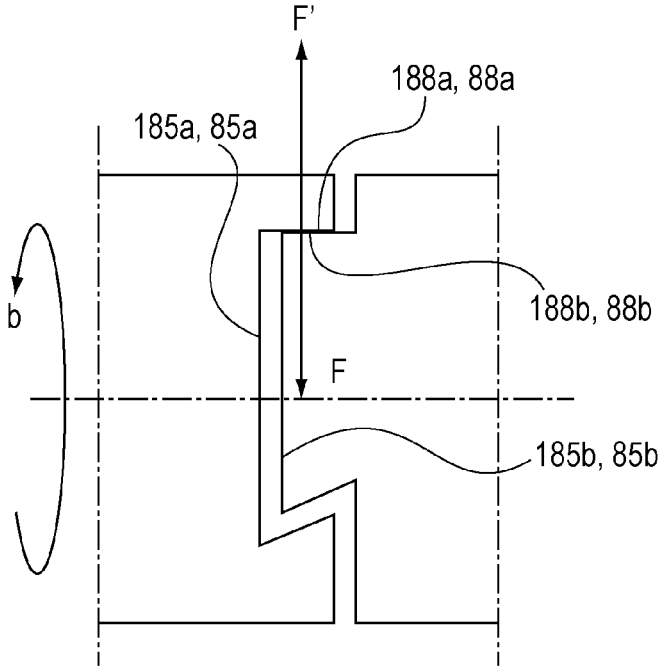

[Fig. 11A]
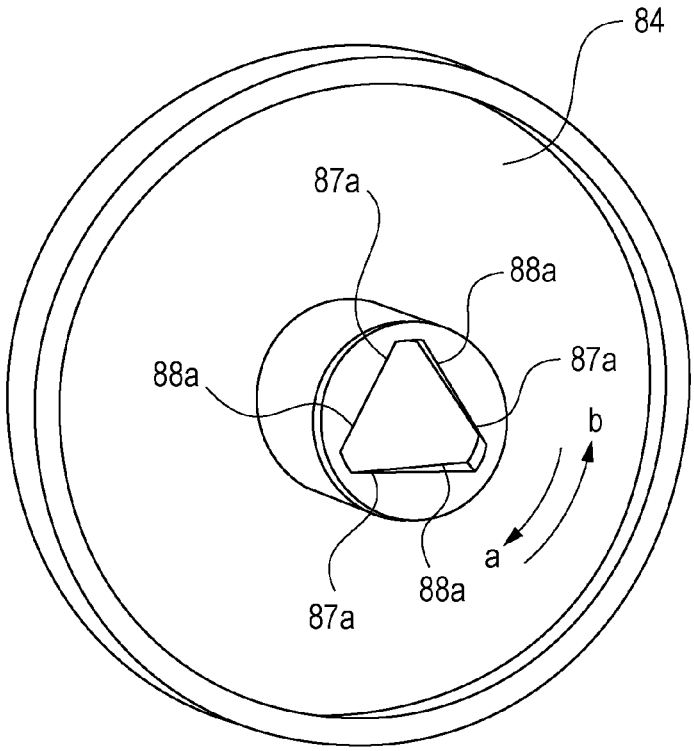
[Fig. 11B]
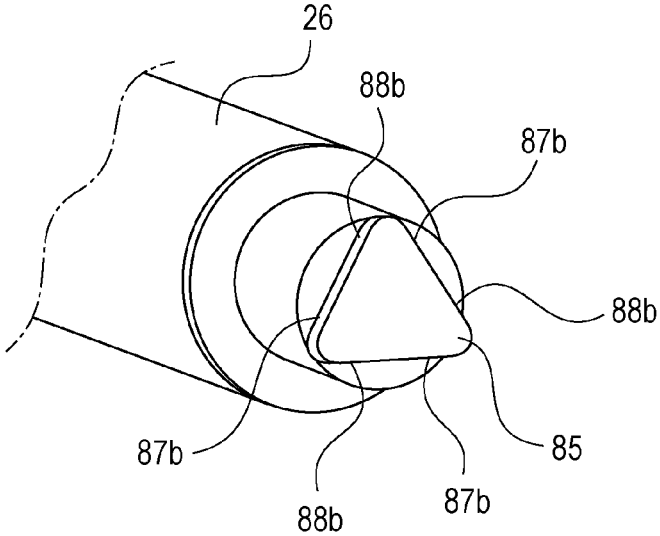

[Fig. 12A]
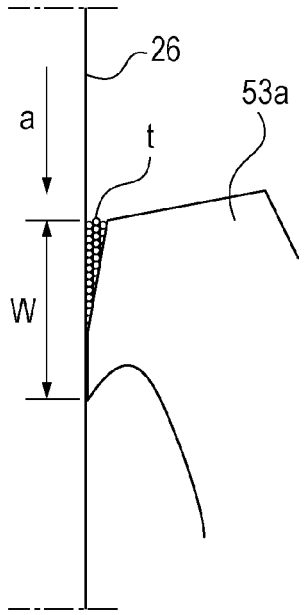
[Fig. 12B]
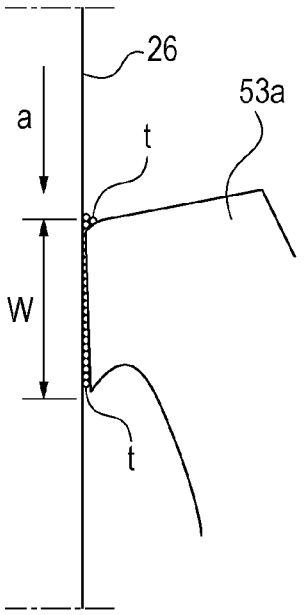

[Fig. 12C]
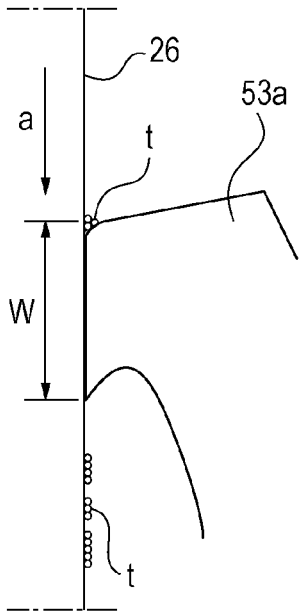
[Fig. 12D]
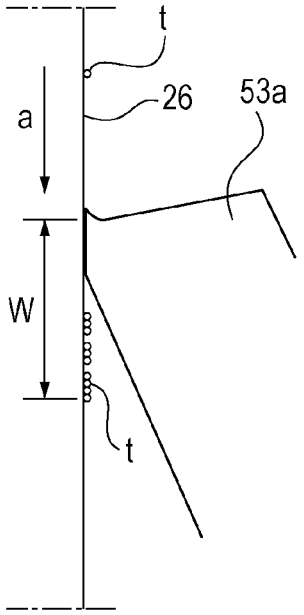

[Fig. 13]
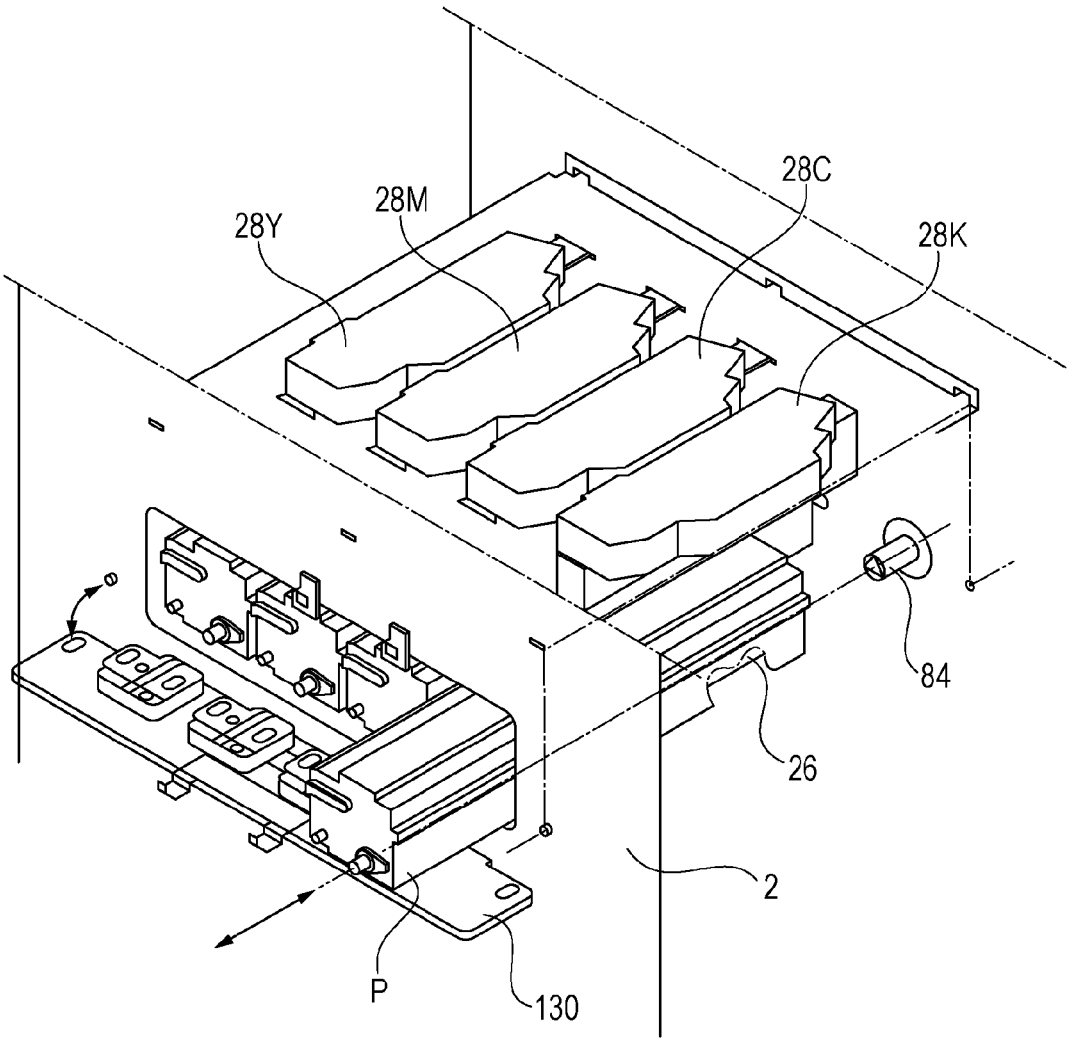

[Fig. 14]
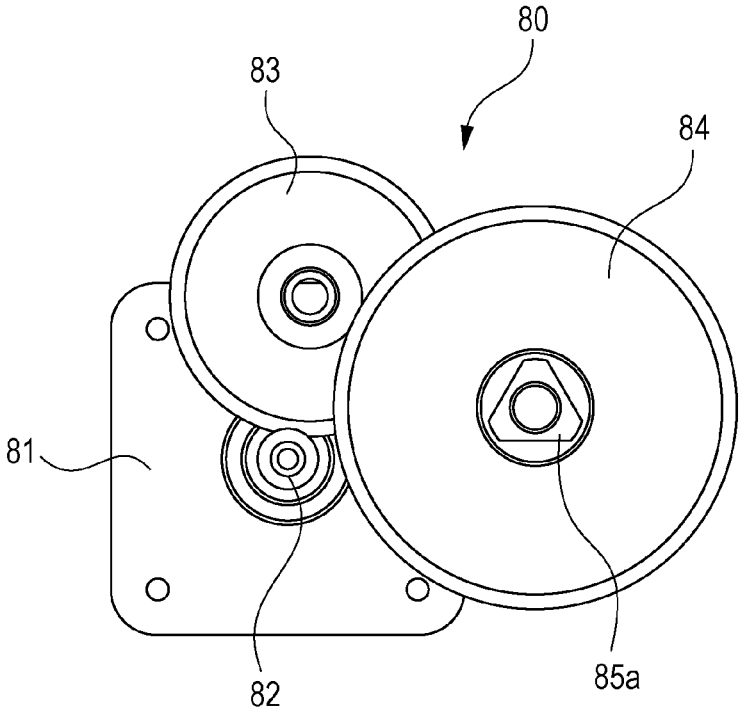
[Fig. 15]
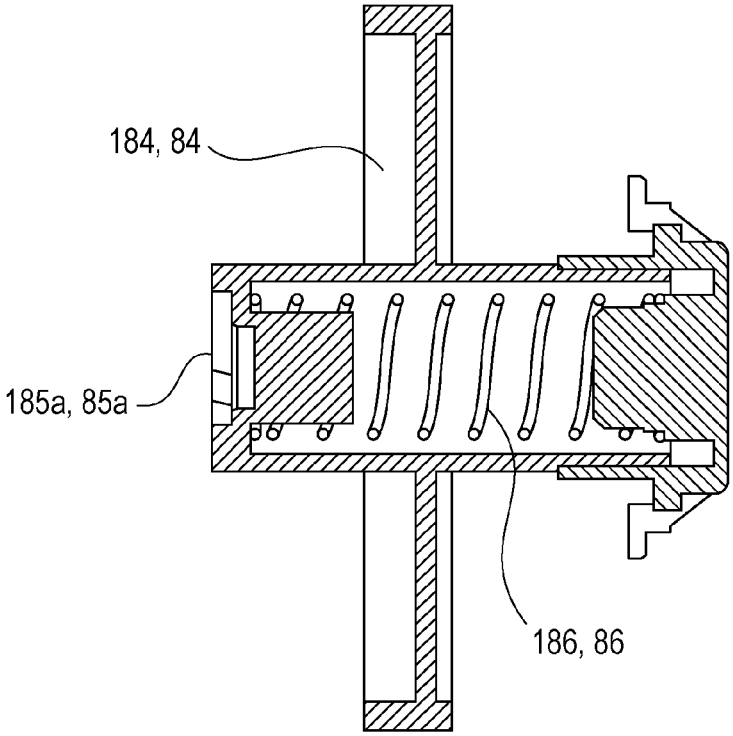

[Fig. 16]
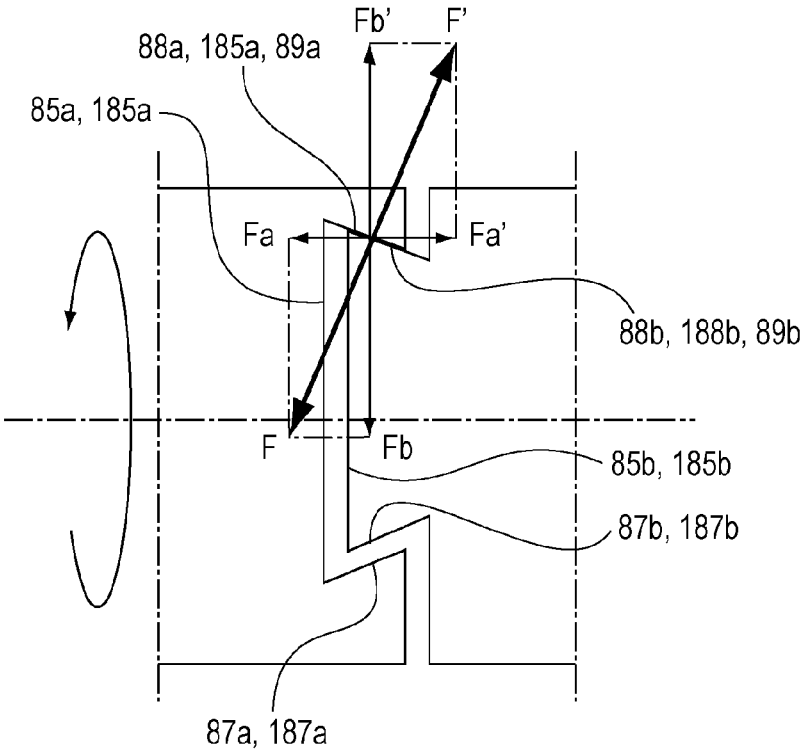
[Fig. 17]
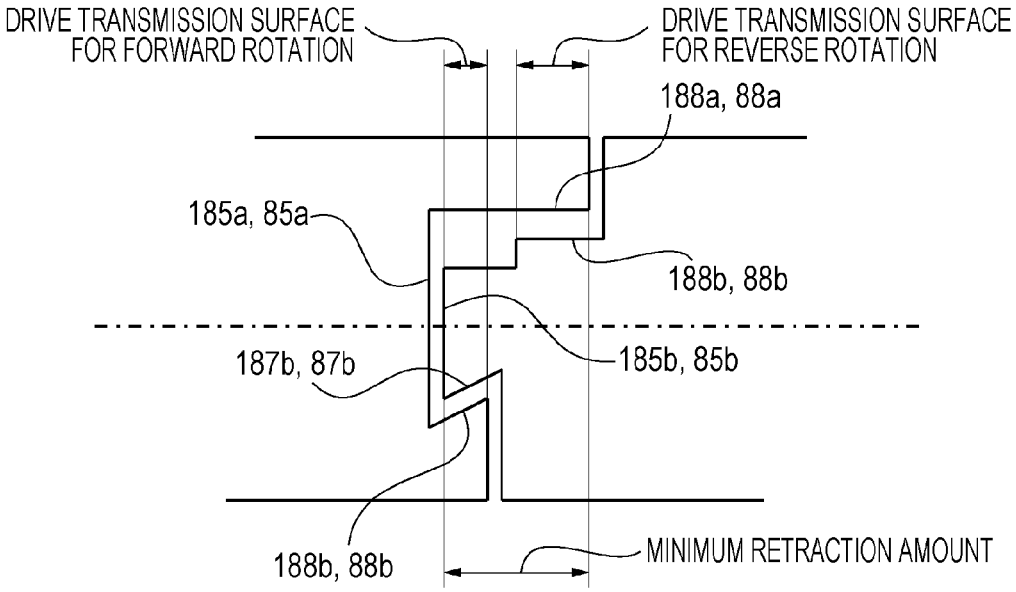

[Fig. 18A]
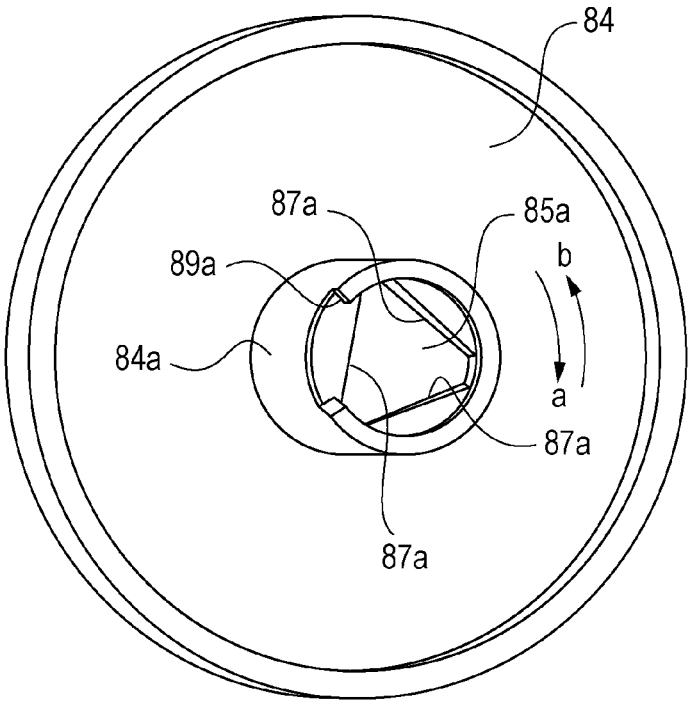
[Fig. 18B]
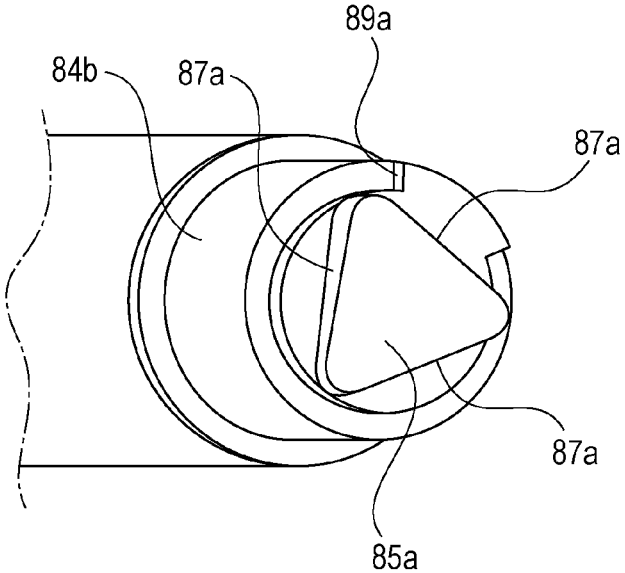

[Fig. 19]
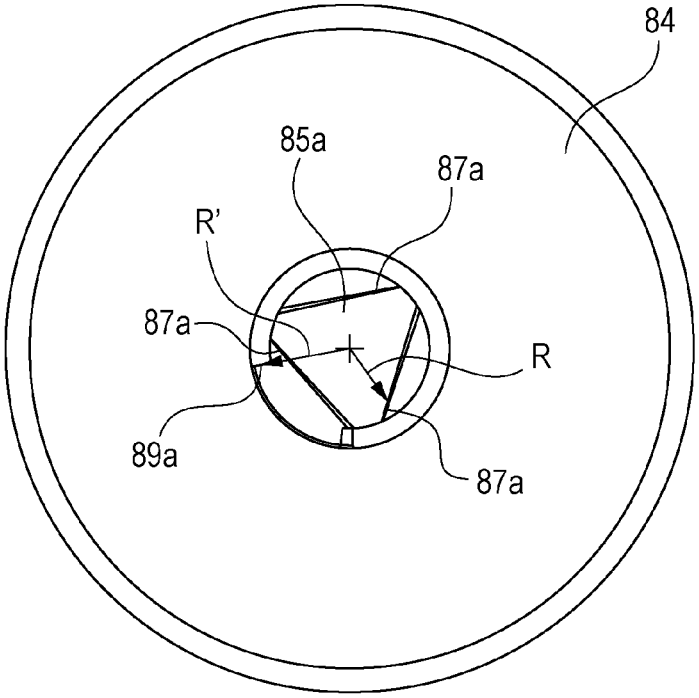
[Fig. 20]
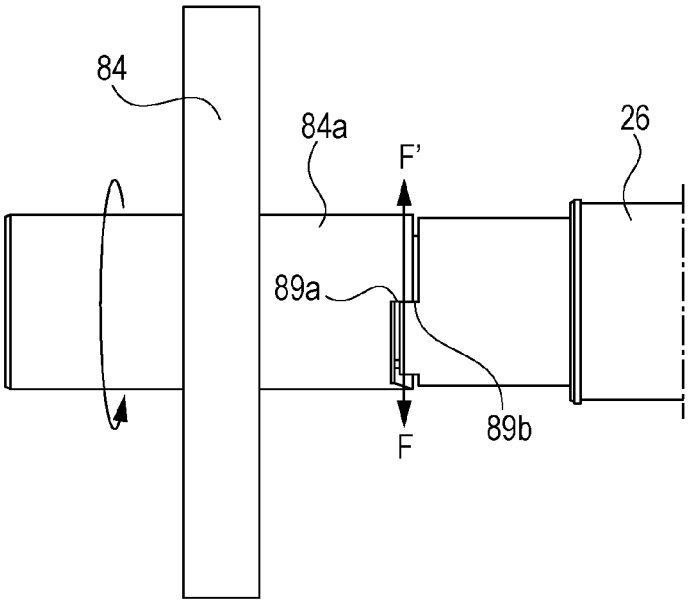

[Fig. 21]
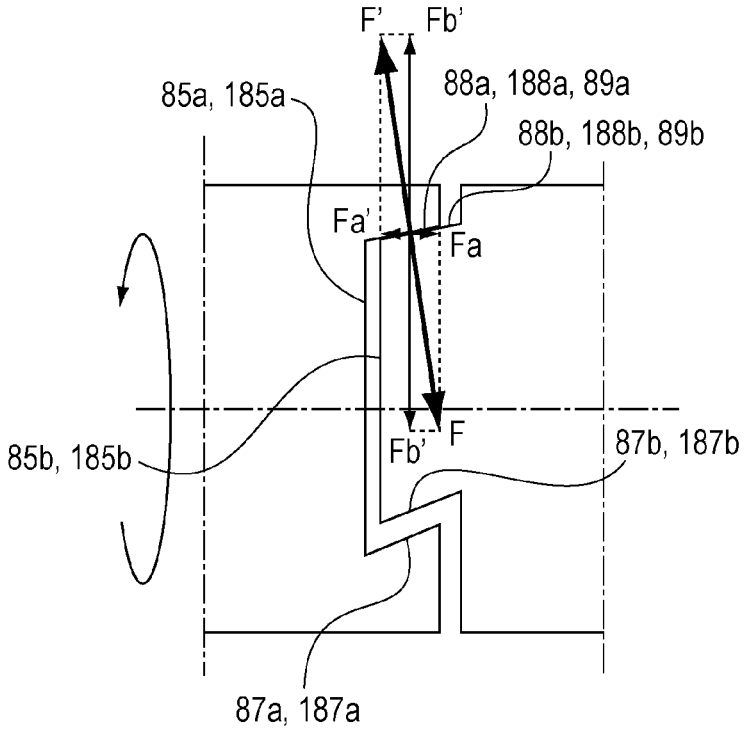

IMAGE FORMING APPARATUS

TECHNICAL FIELD

The present invention relates to image forming apparatuses such as copiers, printers, and facsimile machines, and in particular, relates to image forming apparatuses that include coupling portions that transmit drive from an image forming apparatus main body to a unit such as an intermediate transfer unit or a process cartridge detachably attachable to the image forming apparatuses.

BACKGROUND ART

Image forming apparatuses in which a toner image formed on a photosensitive member is transferred to a recording medium through an intermediate transfer member and heat fixed to the recording medium by a fixing device have been widely used.

In such an image forming apparatus, untransferred toner that has not been transferred by a transfer unit, which transfers the toner image to the recording medium, is collected by a cleaning blade. The cleaning blade disposed between the transfer unit and an image forming unit is in contact with the intermediate transfer member. The cleaning blade also collects a toner image for control (patch image), which is not to be transferred to the recording medium. Furthermore, the cleaning blade collects the toner when jamming of the recording medium occurs during image formation.

In the image forming apparatus in which the cleaning blade disposed between the transfer unit and the image forming unit is in contact with the intermediate transfer member as described above, paper dust and toner clumps are caught by a blade edge as the number of times of image formation increases. This may cause the toner to passing through the cleaning blade.

In order to address this, according to PTL 1, an intermediate transfer belt is stopped and rotated in a reverse direction by a specified distance after completion of an image forming job so as to break up paper dust and toner clumps adhering to a blade edge. The broken paper dust and toner are discharged to the intermediate transfer belt. After that, the intermediate transfer belt is rotated in a forward direction, so that the paper dust and the toner are scraped off and collected by the cleaning blade.

Meanwhile, as a structure that transmits drive to a detachably attachable unit such as an intermediate transfer belt or a process cartridge, there are some related art coupling structures having a twisted polygonal shape. In such a coupling structure, engagement of a coupling is released by rotating the coupling in a reverse direction.

In order to rotate an image bearing body in the reverse direction with the coupling portions, the following method is used. Specifically, during the reverse rotation, forces in directions in which the engagement of the coupling portions is released act on the coupling portions due to the twisted polygonal shape. This moves away a rotating member. Accordingly, in order to prevent the rotating member from being moved away during the reverse rotation, the rotating member needs to be urged by an urging member that applies a greater urging force in a coupling engagement direction, which is opposite to the releasing direction, than the force acting due to the twisted polygonal shape. Furthermore, this urging force constantly, even when image formation is performed (that is, during forward rotation), acts on the components on the unit side such as the intermediate transfer belt or the process cartridge through the coupling portions. Thus, the position of the unit in the axial direction may become unstable. Accordingly, the unit side needs to be held by an urging force that is in an opposite direction to the direction of the urging force received from the rotating member and that is greater than the urging force received from the rotating member. Furthermore, even when the unit side is held by the greater urging force, the rotating member may be slightly misaligned in the engagement release direction of the coupling portions due to a force acting on the coupling portions during the reverse rotation depending on drive torque on the unit side. This may cause losses of drive transmission. Accordingly, when the reverse rotation is controlled as described above, the losses of the drive transmission is considered. This restricts a movement and time required for the control.

CITATION LIST

Patent Literature

PTL 1: Japanese Patent Laid-Open No. 10-10939

SUMMARY OF INVENTION

The present invention provides a coupling structure (shape) with which accuracy in transmission of drive to an object can be maintained during forward rotation and the drive can be efficiently transmitted during reverse rotation.

According to a first aspect of the present invention, a drive transmission mechanism includes a first coupling and a second coupling. The first coupling is rotated by a drive force from a drive source. The second coupling is brought into engagement with the first coupling and receives the drive force from the drive source through the first coupling. At least one of the first coupling and the second coupling is movable in a rotational axis direction. The first coupling includes a first drive transmission surface and a second drive transmission surface. The second coupling includes a third drive transmission surface and a fourth drive transmission surface. When the first coupling and the second coupling are brought into engagement with each other and rotated in a forward direction, the first drive transmission surface and the third drive transmission surface are brought into contact with each other so as to be rotated in the forward direction while producing components of force in directions in which the first coupling and the second coupling are drawn to each other in the rotational axis direction. When the first coupling and the second coupling are brought into engagement with each other and rotated in a reverse direction, the second drive transmission surface and the fourth drive transmission surface are brought into contact with each other so as to be rotated in the reverse direction without producing components of force in directions in which the first coupling and the second coupling are separated from each other in the rotational axis direction.

According to a second aspect of the present invention, an image forming apparatus includes an apparatus main body, a unit, a first coupling, and a second coupling. The unit is detachably attachable to the apparatus main body. The first coupling is provided in the apparatus main body and rotated by a drive force from a drive source. The second coupling is provided in the unit, is brought into engagement with the first coupling, and receives the drive force from the drive source through the first coupling. At least one of the first coupling and the second coupling is movable in a rotational axis direction. The first coupling includes a first drive transmission surface and a second drive transmission surface. The second coupling includes a third drive transmission surface and a fourth drive transmission surface. When the first coupling and the second coupling are brought into engagement with each other and rotated in a forward direction, the first drive transmission surface and the third drive transmission surface are brought into contact with each other so as to be rotated in the forward direction while producing components of force in directions in which the first coupling and the second coupling are drawn to each other in the rotational axis direction. When the first coupling and the second coupling are brought into engagement with each other and rotated in a reverse direction, the second drive transmission surface and the fourth drive transmission surface are brought into contact with each other so as to be rotated in the reverse direction without producing components of force in directions in which the first coupling and the second coupling are separated from each other in the rotational axis direction.

According to a third aspect of the present invention, a drive transmission mechanism includes a first coupling and a second coupling. The first coupling is rotated by a drive force from a drive source. The second coupling that is brought into engagement with the first coupling and that receives the drive force from the drive source through the first coupling. At least one of the first coupling and the second coupling is movable in a rotational axis direction. The first coupling includes a first drive transmission surface and a second drive transmission surface. The second coupling includes a third drive transmission surface and a fourth drive transmission surface. When the first coupling and the second coupling are brought into engagement with each other and rotated in a first direction, the first drive transmission surface and the third drive transmission surface are brought into contact with each other. When the first coupling and the second coupling are brought into engagement with each other and rotated in a second direction, the second drive transmission surface and the fourth drive transmission surface are brought into contact with each other. A first component of force in the rotational axis direction produced between the first drive transmission surface and the third drive transmission surface when the first coupling and the second coupling are rotated in the first direction is greater than a second component of force in the rotational axis direction produced between the second drive transmission surface and the fourth drive transmission surface when the first coupling and the second coupling are rotated in the second direction.

Further features of the present invention will become apparent from the following description of exemplary embodiments with reference to the attached drawings.

BRIEF DESCRIPTION OF DRAWINGS

FIG. 1 illustrates the shapes of couplings on an apparatus main body side and an intermediate transfer belt side according to a first embodiment to which the present invention is applicable.

FIG. 2 is a sectional view of an outline structure of a four-drum full-color image forming apparatus using an intermediate transfer belt.

FIG. 3 is a block diagram of the configuration of the image forming apparatus.

FIG. 4 illustrates operational steps of the image forming apparatus.

FIG. 5 is a perspective view illustrating how an intermediate transfer belt unit is attached to or detached from the image forming apparatus.

FIG. 6 is a front view of a drive unit that drives the intermediate transfer belt.

FIG. 7 is a top view of couplings that transmit drive of the intermediate transfer belt.

FIG. 8 is a top view in which a coupling of the intermediate transfer belt is disconnected.

FIG. 9 illustrates an image of the relationships between forces applied to drive transmission surfaces of the couplings during forward rotation of the intermediate transfer belt (photosensitive drum).

FIG. 10 illustrates an image of the relationships between forces applied to drive transmission surfaces (substantially parallel to a rotational axis) of the couplings during reverse rotation of the intermediate transfer belt (photosensitive drum).

FIG. 11A illustrates the shape of the coupling on the apparatus main body side according to a second embodiment to which the present invention is applicable.

FIG. 11B illustrates the shape of the coupling on the process cartridge side according to a second embodiment to which the present invention is applicable.

FIG. 12A is a sectional view illustrating a state near a free end of a cleaning blade during operation after a post-printing rotation step.

FIG. 12B is a sectional view illustrating a state near the free end of the cleaning blade during the operation after the post-printing rotation step.

FIG. 12C is a sectional view illustrating a state near the free end of the cleaning blade during the operation after the post-printing rotation step.

FIG. 12D is a sectional view illustrating a state near the free end of the cleaning blade during the operation after the post-printing rotation step.

FIG. 13 is a perspective view illustrating how the process cartridge is attached to or detached from the image forming apparatus.

FIG. 14 is a front view of a drive unit of the image forming apparatus.

FIG. 15 is a sectional view of an urging device provided to a drive gear of the intermediate transfer belt (photosensitive drum) of the image forming apparatus.

FIG. 16 illustrates an image of the relationships between the forces applied to the drive transmission surfaces of the couplings during reverse rotation of the photosensitive drum.

FIG. 17 illustrates a case in which the drive transmission surfaces during forward rotation and the drive transmission surfaces during the reverse rotation are out of phase in a direction perpendicular to a rotational axis.

FIG. 18A illustrates the shape of the coupling on the apparatus main body side according to a third embodiment to which the present invention is applicable.

FIG. 18B illustrates the shape of the coupling on the process cartridge side according to the third embodiment to which the present invention is applicable.

FIG. 19 is a front view illustrating the relationship between drive radii of surfaces in contact during forward rotation and reverse rotation.

FIG. 20 illustrates an image of the relationship between forces applied to the drive transmission surfaces (substantially parallel to the rotational axis) of the couplings during the reverse rotation of the photosensitive drum.

FIG. 21 illustrates an image of the relationships between the forces applied to the drive transmission surfaces of the couplings during the reverse rotation of the photosensitive drum.

DESCRIPTION OF EMBODIMENTS

Examples of embodiments of the present invention will be described in detail below with reference to the drawings. It is to be understood that the dimensions, the materials, the shapes, relative arrangement, and the like of elements described in the following embodiments should be appropriately changed in accordance with the structures and various conditions of an apparatus to which the present invention is applied. Accordingly, unless otherwise specifically described, it is to be understood that the scope of the present invention is not limited only to the dimensions, the materials, the shapes, the relative arrangement, and the like of the elements described in the following embodiments.

First Embodiment

An image forming apparatus according to an embodiment of the present invention will be described. Here, as an example of the image forming apparatus, a four-drum full-color electrophotographic image forming apparatus using an intermediate transfer belt out of electrophotographic image forming apparatuses is described. FIG. 2 is a schematic sectional view of an outline structure of the four-drum full-color electrophotographic image forming apparatus using an intermediate transfer belt.

The Outline Structure of the Image Forming Apparatus

Referring to FIG. 2, process cartridges PY, PM, PC, and PBk of four colors, that is, yellow, magenta, cyan, and black are detachably attached to an image forming apparatus main body (referred to as "apparatus main body" hereafter) 2 of a four-drum full-color image forming apparatus 1. An intermediate transfer belt unit 31 and a fixing device 25 are also provided in the apparatus main body 2. The intermediate transfer belt unit 31 includes an intermediate transfer belt 30 serving as an intermediate transfer member (rotating member).

The process cartridges P each include a corresponding one of photosensitive drums 26Y, 26M, 26C and 26Bk. The photosensitive drums 26Y, 26M, 26C and 26Bk each serve as an image bearing member. Furthermore, each of the process cartridges P includes a charger 50 serving as a charging device, a developing device 51 serving as a developing device, and a cleaner 53 serving as a cleaning device. The charger 50, the developing device 51, and the cleaner 53 are integrated into the process cartridge P and arranged around the photosensitive drum 26 of the process cartridge P. The process cartridges P are arranged parallel to one another along the intermediate transfer belt 30.

In each of the process cartridges P, the charger 50 is disposed on an outer circumferential surface of the photosensitive drum 26 and uniformly charges the surface of the photosensitive drum 26. The developing devices 51 develop electrostatic latent images of the colors on the surfaces of the photosensitive drums 26 with toner of the respective colors (yellow, magenta, cyan, and black). The electrostatic latent images are formed by exposing the photosensitive drums 26 to light from respective laser light exposure devices (light exposure devices) 28Y, 28M, 28C, and 28Bk. Developing rollers 54 are each provided in a corresponding one of the developing devices 51. The developing roller 54 can be separated together with the developing device 51 from the photosensitive drum 26 and rotation of the developing roller 54 can be stopped, so that degradation of developer can be prevented. That is, the developing roller 54 together with the developing device 51 can be in contact with and separated from the photosensitive drum 26. The cleaner 53 removes the toner not transferred and adhering to the surface of the photosensitive drum 26 after a toner image has been transferred.

Furthermore, primary transfer rollers 52 are disposed so as to face the photosensitive drums 26 at positions where the intermediate transfer belt 30 is interposed between the photosensitive drums 26 and the primary transfer rollers 52. The primary transfer rollers 52 and the photosensitive drums 26 are included in primary transfer sections.

The intermediate transfer belt unit 31 includes the intermediate transfer belt 30 and three rollers over which the intermediate transfer belt 30 is looped. The three rollers are a drive roller 100, a tension roller 105, and a secondary transfer facing roller 108. By rotating the drive roller 100 by using a belt drive motor 181 that serves as a main body drive source, the intermediate transfer belt 30 is rotated.

The tension roller 105 is movable in the horizontal direction of FIG. 2 in accordance with the length of the intermediate transfer belt 30. A belt cleaner 201 is disposed at a position following the tension roller 105 so as to face the tension roller 105. The belt cleaner 201 serves as a device that removes foreign matter including an untransferred toner that has not been transferred to a recording medium Q on the intermediate transfer belt 30, paper dust, and so forth. A cleaning blade of the belt cleaner 201 is brought into contact with the intermediate transfer belt 30 to scrape off matter adhering to the intermediate transfer belt 30 such as the toner and the paper dust.

The foreign matter such as the toner and the paper dust having been scraped off by the blade is conveyed by a screw or the like and stored in a collection toner container (not illustrated).

Two registration sensors 90 are disposed near both ends of the longitudinal direction of the drive roller 100. The registration sensors 90 detect a toner patch on the intermediate transfer belt 30. The longitudinal direction refers to the axial direction of the rollers and is a width direction perpendicular to a belt conveyance direction.

Furthermore, a secondary transfer roller 27 is disposed so as to face the secondary transfer facing roller 108 and the intermediate transfer belt 30 at a position where the intermediate transfer belt 30 is interposed between the secondary transfer facing roller 108 and the secondary transfer roller 27. The secondary transfer roller 27 and the secondary transfer facing roller 108 are included in a secondary transfer section. The secondary transfer roller 27 is held by a transfer conveyance unit 33.

Furthermore, a feed device 3 that feeds the recording medium Q to the secondary transfer unit is disposed in a lower portion of the apparatus main body 2. The feed device 3 includes a cassette 20, a feed roller 21, a retard roller pair 22, conveyance roller pairs 23*a* and 23*b*, a registration roller pair 24, and so forth. The cassette 20 contains a plurality of recording media Q. The retard roller pair 22 prevents multifeed.

output roller pairs 61, 62, and 63 are provided in a conveyance path downstream of the fixing device 25.

Furthermore, the image forming apparatus 1 is designed to perform duplex printing. After image formation on a first side of the recording medium Q has been performed and this recording medium Q has been output from the fixing device 25, the position of a switching member 69 is changed. This causes the recording medium Q to be conveyed to inversion roller pairs 70 and 71 side. When a trailing end of the recording medium Q has passed a switching member 72, the position of the switching member 72 is changed and at the same time the inversion rollers 71 is rotated in a reverse direction. Thus, the recording medium Q is guided to a duplex conveyance path 73.

The recording medium Q is fed again by rotating duplex-conveyance-path roller pairs 74, 75, and 76, thereby enabling printing on a second side of the recording medium Q.

Referring next to FIG. 3, a control configuration of the image forming apparatus 1 is described. FIG. 3 is a block diagram of the control configuration of the image forming apparatus 1.

The apparatus main body 2 illustrated in FIG. 2 receives RGB image signals from an external host device 10 such as a personal computer communicatively connected to the apparatus main body 2 or a document reader (not illustrated) separately provided in the apparatus main body 2.

An image processing controller (controller) 11 receives an RGB signal, converts it into a CMYK signal, and corrects tone and density. After that, light exposure signals for laser light exposure devices 28 are generated. An image formation controller 12 collectively controls image forming operations, which will be described later. The image formation controller 12 also controls the apparatus main body 2 by using the registration sensors 90 each serving as a patch detector and a mark sensor 91 serving as a mark detector when correcting the image forming operations.

The image formation controller 12 includes a central processing unit (CPU) 121, a read-only memory (ROM) 122, and a random-access memory (RAM) 123. The CPU 121 controls processes performed by this image formation controller 12. Programs or the like performed by this CPU 121 are stored in the ROM 122. Various types of data are stored in the RAM 123 when control processes are performed by the CPU 121.

A plurality of (four herein) image forming units 13 are provided in a rotational direction of the intermediate transfer belt 30. As illustrated in FIG. 2, each of the image forming units 13 includes a corresponding one of the photosensitive drums 26. The image forming unit 13 also includes the charging device, the developing device, the cleaning device, and the light exposure device, which act on this photosensitive drum 26.

A main drive motor 14 serves as a drive device that rotates the intermediate transfer belt 30 and all the photosensitive drums 26 at specified speeds in accordance with instructions from the image formation controller 12.

A registration sensor unit 16 detects the toner patch provided on the intermediate transfer belt 30 by using the registration sensors 90.

A mark sensor unit 17 detects a position indicating mark provided on the intermediate transfer belt 30 by using the mark sensor 91.

Image Forming Operations

Here, the image forming operations of the four-drum full-color image forming apparatus 1 structured as described above are described with reference to FIG. 2. The image forming apparatus 1 can form an image of toner of a plurality of colors (four colors here) on the recording medium Q.

When the image forming operations are started, the recording media Q in the cassette 20 are initially fed by the feed roller 21. Then, the retard roller pair 22 separates one sheet after another from the recording media Q, and each of the sheets is conveyed to the registration roller pair 24 through the conveyance roller pairs 23*a* and 23*b* and the like.

In parallel with this conveyance of the recording medium Q, for example, in the yellow process cartridge PY, the surface of the photosensitive drum 26Y is initially uniformly charged by the charger 50, and then exposed to image light from the laser light exposure device 28Y. Thus, an electrostatic latent image corresponding to a yellow image component of an image signal is formed on the surface of the photosensitive drum 26Y.

Next, the developing roller 54 is brought into contact with the photosensitive drum 26Y while being rotated in the developing device 51 so as to develop the electrostatic latent image with the yellow toner having been charged by the developing device 51. Consequently, the electrostatic latent image becomes visible as a yellow toner image. The yellow toner image having been obtained as described above is transferred through primary transfer onto the intermediate transfer belt 30 by the primary transfer roller 52 to which a primary transfer bias is supplied.

After the toner image has been transferred, the cleaner 53 removes the toner which has not been transferred and adheres to the surface of the photosensitive drum 26Y.

Such a series of toner image forming operations are also performed in the other process cartridges PM, PC, and PBk sequentially at specified timing. There may be a case where, immediately before the image forming operations are started with the developing roller 54 in one of the process cartridges P, the primary transfer is being performed with another process cartridge P on the upstream side. Even in this case, the developing rollers 54 are sequentially brought into contact with the photosensitive drums 26 in order to prevent degradation of the developer. The toner images formed on the photosensitive drums 26 for the respective colors are sequentially transferred through the primary transfer onto the intermediate transfer belt 30 in the respective primary transfer sections so as to be superposed on one another. When the developing operation has been performed, the developing rollers 54 are sequentially separated from the photosensitive drums 26 and the rotation of the developing rollers 54 are sequentially stopped so as to prevent the degradation of the developer even when there is one of the process cartridges P on the downstream side with which the primary transfer is being performed.

Next, the toner images of the four colors having been transferred onto the intermediate transfer belt 30 so as to be superposed on one another as described above are moved to the secondary transfer unit as the intermediate transfer belt 30 is rotated in an arrow direction of FIG. 2.

Also, the recording medium Q is fed to the secondary transfer unit by the registration roller pair 24 at timing adjusted to timing of the movement of the images on the intermediate transfer belt 30.

After that, the toner images of the four colors on the intermediate transfer belt 30 are collectively transferred through secondary transfer onto the recording medium Q by the secondary transfer roller 27 in contact with the intermediate transfer belt 30 with the recording medium Q interposed therebetween. The recording medium Q onto which the toner images have been transferred as described above is conveyed to the fixing device 25 and subjected to heat and pressure, thereby the toner images are fixed onto the recording medium Q. Then, the recording medium Q is output to and stacked on an upper surface of the apparatus main body by the output roller pairs 61, 62, and 63.

The belt cleaner 201 disposed near the tension roller 105 removes the toner that has not been transferred and remains on the surface of the intermediate transfer belt 30 having undergone the secondary transfer.

Operational Steps of the Image Forming Apparatus

FIG. 4 is an operational step chart of this image forming apparatus 1.

(1) Preliminary Multi-Rotation Step

During this step, a startup operation (warming-up) of the image forming apparatus 1 is performed. By turning on a main power switch of the image forming apparatus 1, the image forming apparatus 1 is started up and preparation operations of required process devices are performed.

(2) Wait (Stand-by)

After completion of the specified startup operation period, drive of the image forming apparatus 1 is stopped and the image forming apparatus 1 is held in a wait state until an image forming trigger (printing job start signal) is input.

(3) Preliminary Rotation Step

During this step, the image forming apparatus 1 is driven again in accordance with input of the image forming trigger so as to perform pre-printing job operations of the required process devices.

More practically, this step is performed in the following order: the image forming apparatus 1 receives the image forming trigger; an image is developed by a formatter (developing time may vary depending on the data size of the image and the process speed of the formatter); and the preliminary rotation step is started.

In the case where the image forming trigger is input during the (1) preliminary multi-rotation step, the processing directly moves to the preliminary rotation step after completion of the preliminary multi-rotation step with the (2) wait skipped.

(4) Performing the Printing Job

After completion of the specified preliminary rotation step, an image forming process is performed and the recording medium Q onto which the image has been formed is output.

In the case where the printing job is continuously performed, the image forming process is repeated and the specified number of the recording media Q on which images have been formed are sequentially output.

(5) Sheet Interval Step

An interval step between a trailing end of one of the recording media Q and a leading end of a next one of the recording media Q in the continuous printing job.

(6) Post-Printing Rotation Step

In the case where printing job is performed only on a single recording medium Q, this recording medium Q on which an image has been formed is output (end of the printing job). In the case where the printing job is continuously performed, a last one of the recording media Q on which images have been formed through this continuous printing job is output (end of the printing job). During the post-printing rotation step, the image forming apparatus 1 continues to be driven after completion of this printing job so as to cause the required process devices to perform post-printing job operations even after the printing job has been performed. For example, in the case of a cleaning device using a cleaning blade, when the image forming apparatus 1 has been used for a long time, cleaning performance of the cleaning blade may be degraded due to the foreign matter such as the paper dust caught between the cleaning blade and the intermediate transfer belt 30. This may cause problems with cleaning. In order to address this, the processing is controlled so as to scrape off the paper dust caught between the cleaning blade and the intermediate transfer belt 30 by rotating the intermediate transfer belt 30 in the reverse direction by a specified distance (several cm) at a time when the image formation is not performed such as a time when the post-printing rotation process is performed after completion of the image forming job.

(7) Wait

After completion of the specified post-printing rotation step, the drive of the image forming apparatus 1 is stopped and the image forming apparatus 1 is held in the wait state until the next image forming trigger is input.

A single image forming process A starts from the preliminary rotation step and ends with the post-printing rotation step. When the next image forming trigger is input, a next image forming process B is performed.

A Method of Attaching and Detaching the Intermediate Transfer Belt Unit

A method of attaching and detaching the intermediate transfer belt unit 31 to and from the apparatus main body 2 is described. As illustrated in FIG. 5, a door on the right side of the apparatus main body 2 is opened and the intermediate transfer belt unit 31 is inserted into and removed from the apparatus main body 2 through the right side. At this time, as a right door is opened, a main-body-side coupling 185*a* that transmits drive to the intermediate transfer belt unit 31 is retracted in a direction separating from a coupling 185*b* provided on the intermediate transfer belt 30 side, that is, retracted from a state of FIG. 7 to a state FIG. 8. When the right door is closed, the main-body-side coupling 185*a* is moved to a side where the coupling 185*a* is brought into engagement with the intermediate-transfer-belt-30-side coupling 185*b*, that is, moved from the state of FIG. 8 to the state of FIG. 7. Here, the main-body-side coupling 185*a* serves as a first coupling and the intermediate-transfer-belt-30-side coupling 185*b* serves as a second coupling. The first coupling and the second coupling are included in a drive transmission mechanism.

As illustrated in FIG. 15, a drive gear 184 is held such that the drive gear 184 is movable in the rotational axis direction. Furthermore, the drive gear 184 is urged toward the intermediate transfer belt 30 by an intermediate transfer drive gear urging device 186 such as a spring. During attachment of the intermediate transfer belt unit 31, when the coupling 185*a* and the coupling 185*b* are out of phase, the main-body-side coupling 185*a* is not engaged with the unit-side coupling 185*b*. However, after the attachment, when the drive motor 181 is driven and the coupling 185*a* and the coupling 185*b* are in phase, the coupling 185*a* and the coupling 185*b* are brought into engagement with each other due to an urging force applied by the urging device 186 (see FIG. 15), thereby transmitting a drive force from the drive motor 181.

Next, a drive unit 180 that drives the intermediate transfer belt 30 is described. s illustrated in FIG. 6, the drive unit 180 includes the drive motor 181, a motor gear 182, and the drive gear 184. The drive unit 180 is provided on the apparatus main body side. The coupling 185*a* is integrally provided to the drive gear 184 about a rotational axis of the drive gear 184. Furthermore, as illustrated in FIG. 7, the coupling 185*a* of the drive gear 184 is brought into engagement with the coupling 185*b* disposed at an end in the rotational axis direction of the intermediate transfer belt unit 31, thereby transmitting the drive force from the drive motor 181 to the intermediate transfer belt unit 31.

Next, the shape of couplings 185 is described with reference to FIG. 1. View (a) of FIG. 1 is a perspective view illustrating the shape of the main-body-side coupling 185*a*, and view (b) of FIG. 1 is a perspective view illustrating the shape of the intermediate-transfer-belt-unit-side coupling 185*b*. In the following description, a forward rotational direction for forming an image is indicated by an arrow a direction and a reverse rotational direction is indicated by an arrow b direction. Also, the drive gear 184 side on the main body side is referred to as a drive side, and the intermediate transfer belt unit side to which the drive force is transmitted from the drive gear 184 is referred to as a driven side.

Initially, as illustrated in view (b) of FIG. 1 and FIG. 9, in the driven-side coupling 185*b*, drive transmission surfaces 187*b* (each serving as a third drive transmission surface) in contact with drive transmission surfaces 187*a* (each serving as a first drive transmission surface) of the drive-side coupling 185*a* during the forward rotation is inclined in such a direction in which both the drive transmission surfaces 187*a* and the drive transmission surfaces 187*b* are drawn to each other. Accordingly, as illustrated in FIG. 9, during the forward rotation, due to an inclination angle of the drive transmission surfaces 187*a* and 187*b*, components of force Fa and Fa' act. The drive-side coupling 185*a* and the driven-side coupling 185*b* are drawn to each other in the rotational axis direction due to these components of force Fa and Fa'. Accordingly, a drive force Fb is stably transmitted during the forward rotation.

Meanwhile, as illustrated in view (b) of FIG. 1 and FIG. 10, drive transmission surfaces 188*b* (each serving as a fourth drive transmission surface), which are in contact during the reverse rotation under paper dust removal control using the cleaning blade after completion of the image forming operations, are disposed on an inner side of the drive transmission surfaces 187*b* in the radial directions in contact during the forward rotation. Also, the drive transmission surfaces 188*b* are substantially parallel to a drive roller axis. That is, the drive transmission surfaces 188*b* in contact during the reverse rotation are provided at positions at which the radius from the center of the rotation is smaller than that of the positions of the drive transmission surfaces 187*b* in contact during the forward rotation. During the reverse rotation, the drive transmission surfaces 188*a* (second drive transmission surface) of the drive-side coupling 185*a* are in contact with the drive transmission surfaces 188*b* of the driven-side coupling 185*b*. Components of force in the axial direction acting between the drive transmission surfaces 188*a* and 188*b*, which are in contact with one another during the reverse rotation, (components of force drawn to each other and components of force separating from each other in the rotational axis direction) are zero, which are smaller than the components of the force (Fa and Fa' of FIG. 9) drawn to each other during the forward rotation. Accordingly, as illustrated in FIG. 10, by contact between the drive transmission surfaces 188*a* and 188*b* during the reverse rotation, a drive force F is transmitted while forces with which the drive-side coupling 185*a* and the driven-side coupling 185*b* attempt to separate from each other does not act.

As illustrated in views (a) and (b) of FIG. 1, the drive transmission surfaces 188*a* and 188*b* for the reverse rotation are inside the drive transmission surfaces 187*a* and 187*b* for the forward rotation in the radial directions from the rotational center. The reason for this is to prioritize the stability of the drive during the forward rotation and reduce the amount of deformation of the couplings even when large torque is produced. Furthermore, since load torque during the forward rotation of the intermediate transfer belt 30 is larger than that during the reverse rotation, the drive transmission surfaces for the forward rotation are provided outside the drive transmission surfaces for the reverse rotation in the radial directions so that a side where load torque is larger is disposed outside in the radial directions.

Thus, the drive gear 184 is not moved in the rotational axis direction during the forward rotation and the reverse rotation. This eliminates losses of drive transmission efficiency from the drive side to the driven side, thereby improving rotational accuracy. Thus, also during the reverse rotation under the paper dust removal control using the cleaning blade for the intermediate transfer belt 30, more accurate rotation can be realized. This can reduce control time and allow smaller rotation to be performed.

Furthermore, the coupling 185*a* and the coupling 185*b* are engaged with each other during the forward rotation and the reverse rotation. Thus, the coupling 185*a* and the coupling 185*b* can stably transmit the drive without being separated from each other. This allows engagement heights of the coupling 185*a* and the coupling 185*b* to be reduced for the forward rotation and the reverse rotation. Furthermore, the drive transmission surfaces 187*a*, 187*b*, 188*a*, and 188*b* for the forward rotation and the reverse rotation are in phase in a direction perpendicular to the rotational axis. This can reduce the amount of retraction of the couplings when the couplings are disconnected from each other for replacement of the intermediate transfer belt unit 31. For example, as illustrated in FIG. 17, when the drive transmission surfaces for the forward rotation and the drive transmission surfaces for the reverse rotation are not aligned with one another in a perpendicular direction (contacting and retracting direction of the couplings), a stroke for disconnection of the coupling needs to be increased.

That is, the engagement heights of the couplings and the amount of retraction of the couplings when the couplings are disconnected from each other for replacement of the intermediate transfer belt unit 31 can be reduced. This may reduce the size of the product.

Furthermore, since need of consideration for a relief force during the reverse rotation is dropped, the urging force applied by the urging device 186 (see FIG. 15) that urges the drive gear 184 toward the intermediate transfer belt unit 31 can be reduced to a minimum urging force required for the engagement of the couplings.

In addition, even during a product state not in use for printing, forces applied to the intermediate transfer belt unit 31 and the drive unit 180 can be reduced. This can reduce creep deformation of resin components other than the couplings subjected to the urging force.

Second Embodiment

In the above-described first embodiment, the intermediate transfer belt unit exemplifies the unit detachably attached to the apparatus main body, and the couplings that drive the intermediate transfer belt are described. In the couplings, the drive transmission surfaces for the reverse rotation are substantially parallel to the drive roller axis.

In a second embodiment, with reference to FIGS. 11A to 12D, the process cartridge exemplifies the unit detachably attached to the apparatus main body, and couplings of the process cartridge are described. These couplings of the process cartridge P include drive transmission surfaces that are parts of twisted polygonal shape and are in contact with one another during the reverse rotation. Initially, a rotational operation of the photosensitive drum (rotating member) 26 after completion of the image forming operations is described with reference to FIGS. 12A to 12D. Then, the structures of couplings according to the present embodiment are described with reference to FIGS. 11A and 11B. In FIGS. 11A to 12D, the forward rotational direction is indicated by an arrow a direction and the reverse rotational direction is indicated by an arrow b direction.

When the photosensitive drum 26 is stopped, the surface friction coefficient of the photosensitive drums 26 is locally reduced due to effects of the toner, an external additive t, and the like remaining in a contact region of a cleaning blade 53*a* of the cleaner 53. This reduction of the surface friction coefficient causes load variation. In order to reduce this load variation, the following control is performed according to the present invention. It is to be understood that the following control is an example. The order and the numbers of times of the forward rotation and the reverse rotation, the length of stop time, and the combination of these settings may each be optimized in accordance with an apparatus.

(Operations After the Post-Printing Rotation <Forward Rotation a to One-Second Stop to Forward Rotation a at Reduced Speed to Reverse Rotation b to Stop>)

FIGS. 12A to 12D illustrate states in which the photosensitive drum 26 is rotated and stopped in the following order: the photosensitive drum 26 is rotated in the forward direction; stopped for one second; rotated in the forward direction at a reduced speed compared to a 1/1 speed; and then rotated in the reverse direction. FIG. 12A is an enlarged view of a main portion illustrating a state of a contact portion between the photosensitive drum and the blade during the forward rotation. FIG. 12B is an enlarged view of the main portion illustrating a state of the contact portion between the photosensitive drum and the blade at an initial stage of the speed-reduced forward rotation. FIG. 12C is an enlarged view of the main portion illustrating a state of the contact portion between the photosensitive drum and the blade after the speed-reduced forward rotation. FIG. 12D is an enlarged view of the main portion illustrating a state of the contact portion between the photosensitive drum and the blade during the reverse rotation.

Referring to FIG. 12A, the photosensitive drum 26 is rotated in the forward direction during printing, and a free end portion of the cleaning blade 53*a* is distorted. The free end portion of the cleaning blades 53*a* is in contact with the photosensitive drum 26 in a counter direction to the forward rotational direction of the photosensitive drum 26. Thus, an edge portion at the free end of the cleaning blade 53*a* is dragged by the photosensitive drum 26. This dragging causes the above-described distortion. Fine toner particles and the external additive t having been removed from the photosensitive drum 26 are also moved in the forward rotational direction of the photosensitive drum 26 and likely to enter a gap between the edge portion of the distorted free end of the cleaning blade 53*a* and the photosensitive drum 26.

The distortion at the free end of the cleaning blade 53*a* is unchanged and the fine toner particles and the external additive t having entered the gap at the distorted blade edge portion of the cleaning blade 53*a* remain even when the photosensitive drum 26 is stopped after the forward rotation. When this stopped state is kept for one minute or less, none of the fine toner particles and the external additive t clump. Here, the rotation is stopped for one second.

FIG. 12B illustrates a state in which the speed-reduced forward rotation is started after the above-described stopping of the forward rotation. At this time, since printing has already been completed, there is no need of removing new waste toner, and power that causes the fine toner particles and the external additive t to attempt to enter the gap at the edge portion is substantially eliminated due to speed reduction. Furthermore, since the photosensitive drum 26 is slowly rotated in the forward direction at the reduced speed, the blade 53*a* and the photosensitive drum 26 are likely to be brought into close contact with each other. As illustrated in FIG. 12B, when the blade 53*a* and the photosensitive drum 26 are brought into close contact with each other, new fine toner particles and external additive t are unlikely to enter the gap.

FIG. 12C illustrates a state after completion of the speed-reduced forward rotation. The fine toner particles and the external additive t having been caught between the blade 53*a* and the photosensitive drum 26 are pushed out to the downstream side of the contact portion due to a movement of the photosensitive drum 26. A width (nip width) W of a contact region of the blade 53*a* with the photosensitive drum 26 is about 500 μm. Since a movement distance of the photosensitive drum 26 according to the present embodiment is about 1500 μm in the speed-reduced forward rotation, the width of about 500 μm is sufficient to push out the fine toner particles and the external additive t from the contact region (nip).

FIG. 12D illustrates a state in which the photosensitive drum 26 is rotated in the reverse direction after the above-described speed-reduced forward rotation. The speed of the reverse rotation is the same as that of the forward rotation of FIG. 12A. There are almost no fine toner particles or almost no external additive t between the blade 53*a* and the photosensitive drum 26. Thus, even when the blade is distorted in an opposite direction, no fine toner particles and the external additive t clump at that part. Since the fine toner particles and the external additive t existing near the contact portion of the blade 53*a* haven not clumped, the fine toner particles and the external additive t are scattered over the photosensitive drum 26 and do not adhere to the photosensitive drum 26 when moving away from the contact position of the blade 53*a*. Thus, in the next printing, these fine toner particles and the external additive t do not pass through the cleaning blade 53*a*, and accordingly, no streak is formed in an image. Accordingly, by releasing the distortion at the free end of the blade 53*a* under the above-described control, clumping of the fine toner particles and the external additive t due to blade 53*a* does not occur. By performing similar rotation control between the belt cleaner 201 and the intermediate transfer belt 30 according to the first embodiment, a similar effect is produced.

Methods of Attaching and Detaching the Process Cartridge

Methods of attaching and detaching the process cartridges P to and from the apparatus main body 2 are described. As illustrated in FIG. 13, each of the process cartridges P is attached to and detached from the apparatus main body 2 in a direction perpendicular to a conveyance direction of the recording medium Q. The process cartridge P can be drawn from the apparatus main body 2 by opening a door 130 of the apparatus main body 2 and pulling the process cartridges P in the axial direction of the photosensitive drum 26. Furthermore, the process cartridge P can be set in the apparatus main body 2 by adjusting the position of the process cartridges P to the opening and inserting the process cartridge P, the coupling side of the photosensitive drum 26 first, into the apparatus main body 2. Then, the process cartridge P can be positioned in the axial direction of the photosensitive drum 26 by closing the door 130. An urging member is disposed in the door 130. This urging member allows the process cartridge P to be stably brought into contact with the rear side (drive side) of the apparatus main body 2 so as to maintain the orientation of the process cartridge P. In order to resist forces applied to the process cartridge P that attempt to push out the process cartridge P to the door 130 side (forces such as a reactive force due to the drive and an urging force that urges the drive gear, which will be described later, to the process cartridge P side), the amount of an urging force of the urging member is set to be equal to or greater than these forces applied to the process cartridge P.

Next, a drive unit 80 that drives the photosensitive drum 26 is described. As illustrated in FIG. 14, the drive unit 80 includes a drive motor 81, a motor gear 82, a reduction gear 83, and a drive gear 84. The drive motor 81 serves as a main body drive source. A coupling 85*a* is integrally provided to the drive gear 84 about a rotational axis of the drive gear 84. Furthermore, as illustrated in FIGS. 11A and 11B, the coupling 85*a* of the drive gear 84 is brought into engagement with a coupling 85*b* disposed at an end of the photosensitive drum 26, thereby transmitting a drive force from the drive motor 81 to the photosensitive drum 26. The drive gear 84 is movably held in the rotational axis direction. In order to prevent an insertion property of the process cartridge P from degrading, the drive gear 84 is moved away in a direction separating from the process cartridge P in the case where the couplings 85*a* and 85*b* are out of phase during attachment of the process cartridge P. Furthermore, as illustrated in FIG. 15, the drive gear 84 is urged by an urging member 86 toward the photosensitive drum 26 so as to be engaged with the coupling 85*b* of the photosensitive drum 26. As a result, the urging force applied to the drive gear 84 urges the process cartridge P in the rotational axis direction via the photosensitive drum 26.

The shapes of the couplings 85*a* and 85*b* are described below with reference to FIGS. 11A and 11B. FIG. 11A is a perspective view illustrating the shape of the coupling 85*a* on the main body side, and FIG. 11B is a perspective view illustrating the shape of the coupling 85*b* on the photosensitive drum side. In the following description, the drive gear 84 side on the main body side is referred to as the drive side, and the photosensitive drum 26 side to which the drive force is transmitted from the drive gear 84 is referred to as the driven side.

Initially, as illustrated in FIG. 11B, in the driven-side coupling 85*b*, drive transmission surfaces 87*b* in contact with drive transmission surfaces 87*a* of the drive-side coupling 85*a* during the forward rotation are parts of a projection having a twisted polygonal prism shape on one side. In contrast, as illustrated in FIG. 11A, corresponding to the projecting surfaces of the twisted polygonal prism shape, the drive transmission surfaces 87*a* of the drive-side coupling 85*a* are parts of a twisted hole on the other side, the twisted hole having a polygonal section, and the twist angle and twist direction of this twisted hole are the same as those of the projecting surface of the twisted polygonal prism shape. The above-described twist direction is set such that the coupling 85*a* and the coupling 85*b* are drawn to each other during the forward rotation. Accordingly, as illustrated in FIG. 9, during the forward rotation, due to the twist angles of the couplings 85*a* and 85*b*, the forces Fa and Fa' by which the drive-side coupling 85*a* and the driven-side coupling 85*b* are drawn to each other act. Accordingly, a drive force Fb is stably transmitted during the forward rotation.

As illustrated in FIG. 10, drive transmission surfaces 88, which are brought into contact one another when the photosensitive drum 26 is under load variation reduction control performed after completion of the image forming operations, are drive transmission surfaces 88*a* and 88*b* on the side of the twisted-polygonal-pillar-shaped projecting surfaces 85*b* and the hole 85*a* that face one another. These drive transmission surfaces 88*a* and 88*b* as well as the drive-side coupling 85*a* and the driven-side coupling 85*b* are substantially parallel (within 0.5 degrees according to the present embodiment) to the rotational axis. That is, the angle of the drive transmission surfaces 88 in contact with one another during the reverse rotation is different from the twist angle of the drive transmission surfaces 87 in contact with one another during the forward rotation. Here, assuming that surfaces at the same angle as the twist angle are drawn to one another during the forward rotation. When such surfaces are in contact with one another during the reverse rotation, forces that separate the couplings 85*a* and 85*b* from each other are produced. However, by setting the drive transmission surfaces 88, which are in contact with one another during the reverse rotation, to be substantially parallel to the rotational axis, only a force Fb (Fb=F) in the rotational direction acts without producing the forces that separate the couplings 85*a* and 85*b* from each other during the reverse rotation. Thus, there is no movement of the drive gear 84 in the rotational axis direction during the forward rotation and the reverse rotation. This eliminates losses of the drive transmission efficiency, thereby improving rotational accuracy. Accordingly, when the photosensitive drum 26 is under the load variation reduction control, the photosensitive drum 26 can be rotated more accurately. This can reduce control time and allow smaller rotation to be performed.

Furthermore, since need of consideration for a relief force during the reverse rotation is dropped, the urging force applied by the urging device 86 (see FIG. 15) that urges the drive gear 84 toward the photosensitive drum 26 can be reduced to a minimum urging force required for the engagement of the couplings. That is, a force that pushes out the process cartridge P is reduced. Accordingly, the urging force of the urging member provided in the door 130 to urge the process cartridge P to the drive side can be reduced.

Since the force acting on the process cartridge P can be reduced as described above, operational forces of parts relating to the attachment and detachment of the process cartridge are reduced. This improves usability and reduces deformation (such as creep) due to urging force.

Third Embodiment

In the above-described second embodiment, the couplings of the process cartridge are described, which include drive transmission surfaces that are parts of the twisted polygonal shape are in contact with on another during the reverse rotation.

According to a third embodiment, as illustrated in FIGS. 18A to 19, drive transmission surfaces 89*a* and 89*b* in contact with each other during the reverse rotation are formed on outer circumferential sides of the drive transmission surfaces 87*a* and 87*b* in contact with on another during the forward rotation instead of being the parts of the twisted polygonal shape. That is, a drive radius R of the drive transmission surfaces 89*a* and 89*b* in contact with one another during the reverse rotation is greater than a drive radius R of the drive transmission surfaces 87*a* and 87*b* in contact with one another during the forward rotation (R>R). Specifically, the drive transmission surfaces 89*a* on the drive gear 84 side in contact during the reverse rotation are formed on an outer circumferential surface of a cylindrical portion 84*a* that connects the gear 84 portion and the hole-shaped coupling 85*a* portion to each other. Furthermore, the drive transmission surfaces 89*b* on the process cartridge P side in contact during the reverse rotation are formed on an outer circumferential surface of a cylindrical portion 84*b* that connects the projecting coupling 85*b* portion and the photosensitive drum 26 to each other. These drive transmission surfaces 89*a* and 89*b* in contact with one another during the reverse rotation are substantially parallel (within 0.5 degrees according to the present embodiment) to the rotational axis on both the drive and driven sides. Thus, as illustrated in FIG. 20, by setting the drive transmission surfaces 89*a* and 89*b* substantially parallel to the rotational axis, only a force Fb (F=F) in the rotational direction acts without producing forces that separate the couplings from each other during the reverse rotation. That is, there is no movement of the drive gear 84 in the rotational axis direction. This eliminates losses of the drive transmission efficiency, thereby improving rotational accuracy.

As described above, by setting the drive radius R of the drive transmission surfaces 89*a* and 89*b* in contact with one another during the reverse rotation to be greater than the drive radius R of the drive transmission surfaces 87*a* and 87*b* in contact with one another during the forward rotation, drive forces applied to the drive transmission surfaces 89 of the couplings 85 during the reverse rotation can be reduced. Thus, stiffness of the drive transmission surfaces 89 can be reduced, and the number of drive transmission parts can be reduced. According to the present embodiment, a single drive transmission part is set.

Furthermore, the drive transmission surfaces 89*a* and 89*b* in contact with one another during the reverse rotation are formed in different portions from the twisted polygon-shaped couplings 85*a* and 85*b* portions. Thus, in particular in a component including a coupling portion formed by injection molding resin, integral formation of the coupling portion and the drive gear is further facilitated, and accordingly, the cost can be reduced.

Other Embodiments

According to the embodiments described before, the examples are described in which the coupling portion on the apparatus main body side are supported such that the coupling portion on the apparatus main body side is movable in the rotational axis direction. However, the present invention is not limited to this. A coupling portion on the unit side (the intermediate transfer belt unit side or the process cartridge side) may be supported such that the coupling portion on the unit side is movable in the rotational axis direction.

Furthermore, according to the second embodiment described before, the angle of the drive transmission surfaces 88 in contact with one another during the reverse rotation is substantially parallel to the rotational axis. However, this is not limiting. For example, as illustrated in FIG. 16, even when the drive transmission surfaces 88*a* and 88*b* in contact with one another during the reverse rotation are twisted at an angle (for example, 1 degree or larger relative to the rotational axis) that allows the couplings 85*a* and 85*b* to be drawn to each other in the rotational axis direction during the reverse rotation, the similar effect can be obtained. In this case, the couplings 85*a* and 85*b* are drawn to each other in the rotational axis direction during the reverse rotation and the forward rotation. Thus, reverse rotation can be performed with drive transmission accuracy similar to that in the forward rotation. Furthermore, assuming that the forces in directions in which the couplings 85 are separated from each other act on the drive gear 84. Even in this case, forces (components of force) Fa and Fa' that causes the couplings 85 to be drawn to each other in the rotational axis direction act, and accordingly, the urging force of the urging member 86 of the drive gear 84 can be minimized Also in the first and third embodiments described before, when the drive transmission surfaces in contact with one another during the reverse rotation are similarly structured to those of the above-described structure, the similar effect can be obtained.

Furthermore, referring to FIG. 16, an example is described in which the drive transmission surfaces 88*a* and 88*b* in contact with one another during the reverse rotation are inclined in an opposite direction relative to the rotational axis to a direction of the drive transmission surfaces 87*a* and 87*b* in contact with one another during the forward rotation. However, this is not limiting. Specifically, as illustrated in FIG. 21, the drive transmission surfaces 88*a* and 88*b* in contact with one another during the reverse rotation may be inclined in the same direction relative to the rotational axis as the drive transmission surfaces 87*a* and 87*b* in contact with one another during the forward rotation. Here, an inclination angle of the drive transmission surfaces 88*a* and 88*b* in contact with one another during the reverse rotation is set such that components of force Fa and Fa' in directions separating from each other in the rotational axis direction, the components of force Fa and Fa' acting between the drive transmission surfaces 88*a* and 88*b* in contact with one another during the reverse rotation, are smaller than the components of force Fa and Fa' in directions drawn to each other in the rotational axis direction, the components of force Fa and Fa' acting between the drive transmission surfaces 87*a* and 87*b* in contact with one another during the forward rotation. That is, relative to the rotational axis, the inclination angle of the drive transmission surfaces 88*a* and 88*b* in contact with one another during the reverse rotation is set to be smaller than an inclination angle of the drive transmission surfaces 87*a* and 87*b* in contact with one another during the forward rotation. Also with this structure, the reverse rotation can be performed with similar drive accuracy to that in the forward rotation as is the case with the embodiments described before.

According to the embodiments described before, as examples of a plurality of image forming units, the image forming units of four different colors are described. However, the number of image forming units in use is not limited to this and may be appropriately set.

Also according to the embodiments described before, as examples of the process cartridges detachably attached to the image forming apparatus main body, the photosensitive drums and the process cartridges are described. In this case, each of the process cartridges includes the charging device, the developing device, and the cleaning device, which act on the photosensitive drum as process devices and are integrated into the process cartridge. However, the process cartridge is not limited to this. For example, the process cartridge may include one of the charging device and the developing device integrated thereinto in addition to the photosensitive drum and the cleaning device.

Furthermore, according to the first embodiment described before, the couplings have shapes for driving the intermediate transfer belt. However, the process cartridges may be driven with the couplings having the shapes according to the first embodiment. The combination of the shapes of the couplings may be reversed. The coupling shapes and devices to be driven with the couplings are not specified.

According to the embodiments described before, the printer is described an example of the image forming apparatus. However, the present invention is not limited to this. For example, the image forming apparatus may be a copier, a facsimile machine, or the like, or may be another image forming apparatus such as a multi-function machine having the functions of the copier, the facsimile machine, and the like integrated into the multi-function machine. Alternatively, the image forming apparatus may use a recording medium conveyance member, and toner images of various colors are sequentially transferred onto a recording medium borne by the recording medium conveyance member so as to be superposed on one another. By applying the present invention to these image forming apparatuses, the similar effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-244911, filed Dec. 3, 2014, which is hereby incorporated by reference herein in its entirety.

The invention claimed is:

1. A drive transmission mechanism comprising:

a first coupling rotated by a drive force from a drive source; and a second coupling that is brought into engagement with the first coupling and that receives the drive force from the drive source through the first coupling;

wherein at least one of the first coupling and the second coupling is movable in a rotational axis direction, wherein the first coupling includes a first drive transmission surface and a second drive transmission surface, wherein the second coupling includes a third drive transmission surface and a fourth drive transmission surface, wherein, when the first coupling and the second coupling are brought into engagement with each other and rotated in a forward direction, the first drive transmission surface and the third drive transmission surface are brought into contact with each other so as to be rotated in the forward direction while producing components of force in directions in which the first coupling and the second coupling are drawn to each other in the rotational axis direction, wherein, when the first coupling and the second coupling are brought into engagement with each other and rotated in a reverse direction, the second drive transmission surface and the fourth drive transmission surface are brought into contact with each other so as to be rotated in the reverse direction without producing components of force in directions in which the first coupling and the second coupling are separated from each other in the rotational axis direction, wherein a length in a radial direction between the first drive transmission surface and a center of rotation of the first coupling is greater than a length in the radial direction between the second drive transmission surface and the center of rotation of the first coupling, and wherein a length in the radial direction between the third drive transmission surface and a center of rotation of the second coupling is greater than a length in the radial direction between the fourth drive transmission surface and the center of rotation of the second coupling.

2. The drive transmission mechanism according to claim 1, wherein the second drive transmission surface and the fourth drive transmission surface are substantially parallel to the rotational axis direction.

3. The drive transmission mechanism according to claim 2, wherein, when the first coupling and the second coupling are brought into engagement with each other and rotated in the reverse direction, the second drive transmission surface and the fourth drive transmission surface are brought into contact with each other so as to be rotated in the reverse direction without producing the components of force in the rotational axis direction.

4. The drive transmission mechanism according to claim 1, wherein, when the first coupling and the second coupling are brought into engagement with each other and rotated in the reverse direction, the second drive transmission surface and the fourth drive transmission surface are brought into contact with each other so as to produce the components of force in the directions in which the first coupling and the second coupling are drawn to each other in the rotational axis direction.

5. The drive transmission mechanism according to claim 1, further comprising:

an urging member that urges the first coupling toward the second coupling in the rotational axis direction.

6. An image forming apparatus comprising:

an apparatus main body;

a belt unit detachably attachable to the apparatus main body, the belt unit including a transfer belt to which a toner image is transferred from a photosensitive member;

a first coupling that is provided in the apparatus main body and that is rotated by a drive force from a drive source; and a second coupling that is provided in the unit, that is brought into engagement with the first coupling, and that receives the drive force from the drive source through the first coupling;

wherein at least one of the first coupling and the second coupling is movable in a rotational axis direction, wherein the first coupling includes a first drive transmission surface and a second drive transmission surface, wherein the second coupling includes a third drive transmission surface and a fourth drive transmission surface, wherein, when the first coupling and the second coupling are brought into engagement with each other and rotated in a forward direction, the first drive transmission surface and the third drive transmission surface are brought into contact with each other so as to be rotated in the forward direction while producing components of force in directions in which the first coupling and the second coupling are drawn to each other in the rotational axis direction, and wherein, when the first coupling and the second coupling are brought into engagement with each other and rotated in a reverse direction, the second drive transmission surface and the fourth drive transmission surface are brought into contact with each other so as to be rotated in the reverse direction without producing components of force in directions in which the first coupling and the second coupling are separated from each other in the rotational axis direction wherein a length in a radial direction between the first drive transmission surface and a center of rotation of the first coupling is greater than a length in the radial direction between the second drive transmission surface and the center of rotation of the first coupling, and wherein a length in the radial direction between the third drive transmission surface and a center of rotation of the second coupling is greater than a length in the radial direction between the fourth drive transmission surface and the center of rotation of the second coupling.

7. The image forming apparatus according to claim 6, wherein the second drive transmission surface and the fourth drive transmission surface are substantially parallel to the rotational axis direction.

8. The image forming apparatus according to claim 7, wherein, when the first coupling and the second coupling are brought into engagement with each other and rotated in the reverse direction, the second drive transmission surface and the fourth drive transmission surface are brought into contact with each other so as to be rotated in the reverse direction without producing the components of force in the rotational axis direction.

9. The image forming apparatus according to claim 6, wherein, when the first coupling and the second coupling are brought into engagement with each other and rotated in the reverse direction, the second drive transmission surface and the fourth drive transmission surface are brought into contact with each other so as to produce the components of force in the directions in which the first coupling and the second coupling are drawn to each other in the rotational axis direction.

10. The image forming apparatus according to claim 6, wherein the belt unit includes a cleaning blade in contact with the transfer belt so as to collect toner from the transfer belt.

11. The image forming apparatus according to claim 10, wherein, when the toner is removed from a nip formed between the cleaning blade and the transfer belt, the first coupling and the second coupling are engaged with each other and rotated in the reverse direction.

12. The image forming apparatus according to claim 10, wherein, when the toner is removed from a nip formed between the cleaning blade and the photosensitive member, the first coupling and the second coupling are engaged with each other and rotated in the reverse direction.

13. The image forming apparatus according to claim 6, further comprising:

an urging member that urges the first coupling toward the second coupling in the rotational axis direction.

14. The drive transmission mechanism according to claim 1, wherein the rotational axis direction is a direction along which the center of rotation of the first coupling and the center of rotation the second coupling are provided.

15. The drive transmission mechanism according to claim 6, wherein the rotational axis direction is a direction along which the center of rotation of the first coupling and the center of rotation the second coupling are provided.

16. An image forming apparatus comprising:

an apparatus main body;

a photosensitive unit detachably attachable to the apparatus main body, the unit including a photosensitive member and a cleaning blade that is in contact with the photosensitive member so as to collect toner from the photosensitive member, a first coupling that is provided in the apparatus main body and that is rotated by a drive force from a drive source; and a second coupling that is provided in the unit, that is brought into engagement with the first coupling, and that receives the drive force from the drive source through the first coupling;

wherein at least one of the first coupling and the second coupling is movable in a rotational axis direction, wherein the first coupling includes a first drive transmission surface and a second drive transmission surface, wherein the second coupling includes a third drive transmission surface and a fourth drive transmission surface, wherein, when the first coupling and the second coupling are brought into engagement with each other and rotated in a forward direction, the first drive transmission surface and the third drive transmission surface are brought into contact with each other so as to be rotated in the forward direction while producing components of force in directions in which the first coupling and the second coupling are drawn to each other in the rotational axis direction, and wherein, when the first coupling and the second coupling are brought into engagement with each other and rotated in a reverse direction, the second drive transmission surface and the fourth drive transmission surface are brought into contact with each other so as to be rotated in the reverse direction without producing components of force in directions in which the first coupling and the second coupling are separated from each other in the rotational axis direction, wherein a length in a radial direction between the first drive transmission surface and a center of rotation of the first coupling is greater than a length in the radial direction between the second drive transmission surface and the center of the rotation of the first coupling, and wherein a length in the radial direction between the third drive transmission surface and a center of rotation of the second coupling is greater than a length in the radial direction between the fourth drive transmission surface and the center of rotation of the second coupling.

* * * * *